US012215702B2

(12) United States Patent
Cui

(10) Patent No.: US 12,215,702 B2
(45) Date of Patent: Feb. 4, 2025

(54) ROTATION DRIVING MECHANISM OF AIR SUPPLY APPARATUS, AIR SUPPLY APPARATUS, AND HOUSEHOLD APPLIANCE

(71) Applicants: GD MIDEA ENVIRONMENT APPLIANCES MFG CO., LTD., Zhongshan (CN); MIDEA GROUP CO., LTD., Foshan (CN)

(72) Inventor: Shiqiang Cui, Zhongshan (CN)

(73) Assignees: GD MIDEA ENVIRONMENT APPLIANCES MFG CO., LTD., Zhongshan (CN); MIDEA GROUP CO., LTD., Foshan (CN)

( * ) Notice: Subject to any disclaimer, the term of this patent is extended or adjusted under 35 U.S.C. 154(b) by 8 days.

(21) Appl. No.: 18/494,740

(22) Filed: Oct. 25, 2023

(65) Prior Publication Data

US 2024/0052843 A1 Feb. 15, 2024

Related U.S. Application Data

(62) Division of application No. 17/773,032, filed as application No. PCT/CN2020/106633 on Aug. 3, 2020, now Pat. No. 11,835,052.

(30) Foreign Application Priority Data

Apr. 2, 2020 (CN) ..... 202010254409.1
Apr. 2, 2020 (CN) ..... 202010254425.0
Apr. 2, 2020 (CN) ..... 202020462542.1

(51) Int. Cl.
*F04D 25/10* (2006.01)

(52) U.S. Cl.
CPC ..... *F04D 25/105* (2013.01)

(58) Field of Classification Search
CPC ..... F04D 25/105
See application file for complete search history.

(56) References Cited

FOREIGN PATENT DOCUMENTS

JP S4913252 U 2/1974
KR 20190115206 * 10/2019

OTHER PUBLICATIONS

Second OA received in CA Application No. 3, 156,695; mailed Jun. 12, 2024.
First OA received in JP Application No. 2023-181281; mailed Jul. 16, 2024.

* cited by examiner

*Primary Examiner* — Brian O Peters

(57) ABSTRACT

A rotation driving mechanism of an air supply apparatus, an air supply apparatus, and a household appliance. The rotation driving mechanism of the air supply apparatus comprises: a fixed bracket; a rotary bracket, and the rotary bracket is sleeved on the fixed bracket and may rotate with respect to the fixed bracket; and a driving member, and the driving member is provided on the fixed bracket and used for driving the rotary bracket to rotate. Therefore, compared with the prior art, by means of the coordination of the fixed bracket, the rotary bracket, and the driving member, the size of the rotation driving mechanism can be reduced; after the rotation driving mechanism is mounted on the air supply apparatus, the air supply apparatus can have a better appearance.

17 Claims, 12 Drawing Sheets

ROTATION DRIVING MECHANISM OF AIR SUPPLY APPARATUS, AIR SUPPLY APPARATUS, AND HOUSEHOLD APPLIANCE

CROSS-REFERENCES TO RELATED APPLICATIONS

The present disclosure is a Divisional application of U.S. application Ser. No. 17/773,032, filed on Apr. 28, 2022, which claims priority to Chinese Patent Application No. 202020462542.1, No. 202010254409.1 and No. 202010254425.0 filed with China National Intellectual Property Administration on Apr. 2, 2020, the entireties of which are herein incorporated by reference.

FIELD

The present disclosure relates to the field of household appliances, and in particular to a rotation driving mechanism of an air supply apparatus, an air supply apparatus, and a household appliance.

BACKGROUND

In the related art, the rotation driving mechanism of the existing air supply apparatus realizes the head-shaking function of an air supply apparatus through a crank and rocker mechanism. But the size of the rotation driving mechanism is large, which makes the air supply apparatus unsightly. The crank and rocker mechanism has a pole, greatly limiting the shaking angle.

SUMMARY

The present disclosure aims to solve at least one of the problems existing in the prior art or related art.

To this end, in the first aspect, the present disclosure provides a rotation driving mechanism of an air supply apparatus. The size of the rotation driving mechanism of the air supply apparatus is small, and after a rotary driving mechanism is mounted on the air supply apparatus, the air supply apparatus can be more pleasing to the eye and the shaking angle of the rotary component of air supply apparatus can also be enlarged.

A second aspect of the present disclosure proposes an air supply apparatus.

A third aspect of the present disclosure proposes a household appliance.

The rotation driving mechanism of an air supply apparatus according to the present disclosure comprises a fixed bracket; a rotary bracket, and the rotary bracket is sleeved on the fixed bracket and is rotatable with respect to the fixed bracket; and a driving member, and the driving member is provided on the fixed bracket, and the driving member is used for driving the rotary bracket to rotate.

According to the rotation driving mechanism of an air supply apparatus according to the present disclosure, compared with the prior art, by means of the coordination of the fixed bracket, the rotary bracket, and the driving member, the size of the rotation driving mechanism can be reduced; after the rotation driving mechanism is mounted on the air supply apparatus, the air supply apparatus can have a better appearance; moreover, the rotation angle of the rotary bracket with respect to the fixed bracket is not limited, and thus, the shaking angle of the rotary component of the air supply apparatus can be enlarged.

In some embodiments of the present disclosure, the rotation driving mechanism of an air supply apparatus further comprises: a first transmission member, the rotary bracket being provided with a second transmission member drivingly mating with the first transmission member, and the first transmission member being connected to a driving shaft of the driving member.

According to some embodiments of the present disclosure, the fixed bracket comprises a body portion, the body portion defines a mounting groove, a side wall of the mounting groove has a first through hole, the first transmission member is located in the mounting groove, and the first transmission member drivingly mates with the second transmission member via the first through hole.

In some embodiments of the present disclosure, the second transmission member is provided on the inner wall surface of the rotary bracket opposite to the fixed bracket.

In some embodiments of the present disclosure, the first transmission member is a gear and the second transmission member is a rack.

In some embodiments of the present disclosure, the rotation driving mechanism of an air supply apparatus further comprises: a damper, and the side wall of the mounting groove has a second through hole, the damper is provided on the fixed bracket and is located in the mounting groove, and the damper drivingly mates with the second transmission member via the second through hole.

In some embodiments of the present disclosure, the rotation driving mechanism of an air supply apparatus further comprises: a support bearing, the support bearing being supported between the fixed bracket and the rotary bracket.

In some embodiments of the present disclosure, the outer wall surface of a bottom wall of the mounting groove is provided with a mounting post, an inner ring of the support bearing is sleeved on the mounting post, and an outer ring of the support bearing is connected to the rotary bracket.

In some embodiments of the present disclosure, the rotation driving mechanism of an air supply apparatus further comprises: a friction plate, and the rotary bracket defines a fitting groove, the bottom wall of the fitting groove is provided with a third through hole, and the friction plate is sleeved on the mounting post and abuts against an outer end of the third through hole.

In some embodiments of the present disclosure, the rotation driving mechanism of an air supply apparatus further comprises: a snap spring, and a circumferential wall surface of the mounting post is provided with a positioning groove, the snap spring is provided in the positioning groove, and the snap spring abuts an end surface of the friction plate away from the third through hole.

In some embodiments of the present disclosure, a first mounting portion is provided on the edge of the open end of the mounting groove and the driving member is provided with a second mounting portion connected to the first mounting portion.

In some embodiments of the present disclosure, the first mounting portion is provided with a first positioning portion and the second mounting portion is provided with a second positioning portion connected to the first positioning portion.

In some embodiments of the present disclosure, the rotation driving mechanism of an air supply apparatus further comprises: a Hall assembly, and the Hall assembly comprises a Hall plate and a magnet, and one of the Hall plate and the magnet is provided on the fixed bracket, and the other is provided on the rotary bracket.

In some embodiments of the present disclosure, the fixed bracket is provided with a first limiting structure and the rotary bracket is provided with a second limiting structure coordinating with the first limiting structure in limiting.

In some embodiments of the present disclosure, the central axis of the driving member, the central axis of the fixed bracket, and the central axis of the rotary bracket coincide.

In some embodiments of the present disclosure, the central axis of the fixed bracket and the central axis of the rotary bracket coincide, and the central axis of the driving member and the central axis of the fixed bracket do not coincide.

In some embodiments of the present disclosure, the damper is multiple, the second through hole is multiple, and multiple dampers and multiple second through holes are in a one-to-one correspondence.

In some embodiments of the present disclosure, the driving member is a driving motor.

The air supply apparatus according to the present disclosure comprises: a first fixed seat; a second fixed seat, the second fixed seat being connected to a handpiece of the air supply apparatus; and a rotation driving mechanism, the rotation driving mechanism having a fixed bracket and a rotary bracket, the fixed bracket being fixedly connected to the first fixed seat, and the rotary bracket being fixedly connected to the second fixed seat; and the rotary bracket is sleeved on the fixed bracket, and the rotation driving mechanism further has a driving assembly, and the driving assembly is adapted to drive the rotary bracket to rotate around the pitch axis.

According to the air supply apparatus of the present disclosure, through the coordination of the first fixed seat, the second fixed seat, and the rotation driving mechanism, the size of the rotation driving mechanism can be reduced compared with the prior art. After the air supply apparatus is assembled, the air supply apparatus can be made more pleasing to the eye, and improving the market competitiveness of the air supply apparatus.

In some embodiments of the present disclosure, the pitch axis is parallel to the horizontal plane.

In some embodiments of the present disclosure, the driving assembly includes: a driving member and a first transmission member, and the first transmission member is connected to the driving member, and the rotary bracket is provided with a second transmission member drivingly engaging with the first transmission member.

In some embodiments of the present disclosure, the rotation driving mechanism further comprises: a support bearing, and the fixed bracket comprises a body portion, the body portion defines a mounting groove, an outer wall surface of a bottom wall of the mounting groove is provided with a mounting post, an inner ring of the support bearing is sleeved on the mounting post, and an outer ring of the support bearing is connected to the rotary bracket.

In some embodiments of the present disclosure, the rotary bracket defines a through-hole, the through-hole passing through the rotary bracket in a thickness direction of the rotary bracket, and the through-hole being sleeved on an outer side of the fixed bracket and the support bearing.

In some embodiments of the present disclosure, the inner wall surface of the through-hole is provided with an annular boss and the inner wall surface of the annular boss is provided with the second transmission member.

In some embodiments of the present disclosure, the inner wall surface of the through-hole is provided with a stopper boss, the stopper boss being located between the annular boss and the support bearing, and the stopper boss abutting the support bearing.

In some embodiments of the present disclosure, the rotation driving mechanism further comprises: a snap spring, and the snap spring is sleeved on the mounting post and located at one end of the support bearing away from the fixed bracket.

In some embodiments of the present disclosure, the rotation driving mechanism further comprises: a bearing inner ring stop, and the bearing inner ring stop is provided on the fixed bracket and is located at one end of the support bearing away from the fixed bracket.

In some embodiments of the present disclosure, the rotation driving mechanism further comprises: a bearing outer ring stop, the bearing outer ring stop being provided on the rotary bracket and located at one end of the support bearing away from the fixed bracket.

In some embodiments of the present disclosure, the rotation driving mechanism further comprises: an annular friction plate, the body portion being sleeved on the outer side of the friction plate, and the friction plate being sleeved on the outer side of the rotary bracket.

In some embodiments of the present disclosure, the side wall of the mounting groove has a first through hole, the first transmission member being located in the mounting groove, and the first transmission member drivingly mating with the second transmission member through the first through hole.

In some embodiments of the present disclosure, the first transmission member is a gear and the second transmission member is a rack.

In some embodiments of the present disclosure, the rotation driving mechanism further comprises: a damper, the side wall of the mounting groove having a second through hole, the damper being provided in the mounting groove, and the damper drivingly mating with the second transmission member by passing through the second through hole.

In some embodiments of the present disclosure, the rotation driving mechanism further comprises: a Hall assembly, and the Hall assembly comprises a Hall plate and a magnet, and one of the Hall plate and the magnet is provided on the fixed bracket, and the other is provided on the rotary bracket.

In some embodiments of the present disclosure, the depression angle of the rotary bracket is A, meeting the relational expression: $-10° \leq A \leq 0'$; the elevation angle of the rotary bracket is B, meeting the relational expression: $0° \leq B \leq 90°$.

In some embodiments of the present disclosure, the air supply apparatus further comprises: a damping mechanism, the damping mechanism being provided on the fixed bracket and being pivotably connected to the rotary bracket.

In some embodiments of the present disclosure, the rotary bracket has a damping mechanism connection structure, and the damping mechanism connection structure is sleeved on the damping mechanism.

In some embodiments of the present disclosure, the damping mechanism connection structure has a first routing channel and the damping mechanism has a second routing channel communicating with the first routing channel.

In view of this, the present disclosure proposes a household appliance, comprising: a second fixed seat; a first fixed seat; and a rotational structure, the rotational structure comprising a fixed bracket and a rotary bracket, the fixed bracket being connected to the second fixed seat, and the rotary bracket being connected to the first fixed seat; and the rotary bracket is adapted to rotate about the fixed bracket to link the first fixed seat to rotate about the second fixed seat.

The household appliance provided in the present disclosure, comprises a second fixed seat, a first fixed seat, and a rotational structure. The second fixed seat and the first fixed seat are connected via the rotational structure, and the rotational structure can drive the first fixed seat to rotate. The rotational structure comprises a fixed bracket and a rotary bracket, the fixed bracket is connected to the second fixed seat, and the rotary bracket is connected to the first fixed seat. The rotary bracket is adapted to rotate about the fixed bracket, and driving the first fixed seat to rotate about the fixed bracket, i.e. the first fixed seat is driven to rotate about the second fixed seat, achieving the rotation of the first fixed seat and the components connected thereto in the household appliance.

According to the above-mentioned household appliance provided by the present disclosure, it can also have the following additional embodiments.

In the above embodiment, further, the household appliance further comprises: a first damping frame connected to the first fixed seat, and a second damping frame connected to the fixed bracket, and the second damping frame is sleeved on the first damping frame, and the first damping frame is adapted to rotate around the second damping frame.

In this embodiment, the household appliance further comprises a first damping frame and a second damping frame. The first damping frame is connected to the first fixed seat, and the second damping frame is connected to the fixed bracket. Therefore, the first fixed seat can be supported by the first damping frame and the second damping frame, and the reliability of the mounting of the first fixed seat is improved. The second damping frame is sleeved on the first damping frame, and the first damping frame can rotate around the second damping frame and the first fixed seat can rotate around the second fixed seat under the driving of the rotary bracket.

In any of the above embodiments, further, damping fluid is provided between the first damping frame and the second damping frame.

In this embodiment, damping fluid is provided between the first damping frame and the second damping frame to provide a damping force as the first damping frame rotates around the second damping frame, ensuring the stability of the household appliance.

In any of the above embodiments, further, the rotation angle of the first fixed seat is greater than 0° and less than or equal to 200°.

In this embodiment, the rotation angle of the first fixed seat is greater than or equal to 0° and less than or equal to 200°. Specifically, the elevation angle of the rotation of the first fixed seat is greater than or equal to 0° and less than or equal to 90°, and the depression angle of the first fixed seat is greater than or equal to 0° and less than or equal to 10°, and the elevation angle of the first fixed seat is the angle of the rotation of the first fixed seat from a horizontal position to an upward side, and the depression angle of the first fixed seat is the angle of the rotation of the first fixed seat from a horizontal position to a downward side.

In any of the above embodiments, further, the household appliance further comprises: a Hall plate arranged on the second fixed seat, and the first fixed seat is further provided with a magnetic member, and the Hall plate is connected to the magnetic member.

In this embodiment, the Hall plate is provided on the second fixed seat, and a magnetic member is provided on the first fixed seat. The movement of the first fixed seat at any angle can be realized through the coordination between the Hall plate and the magnetic member, namely, the coordination between the Hall plate and the magnetic member can enable the first fixed seat to rotate at any specified angle around the second fixed seat. For example, the first fixed seat is required to rotate any specified angle around the second fixed seat by 30° or 60° or 90°, etc. from an initial position.

Specifically, the Hall plate is an component with the Hall effect.

In any of the above embodiments, further, the second fixed seat is provided with a hollow portion, the hollow portion is provided corresponding to the first damping frame, the household appliance further comprises a connecting wire, and the connecting wire is adapted to be connected to the second fixed seat by passing through the hollow portion from the first fixed seat.

In this embodiment, the second fixed seat is provided with a hollow portion, and the household appliance further comprises a connecting wire. The connecting wire can pass through the hollow portion, namely, the connecting wire can pass through the hollow portion to connect to the first fixed seat and other components thereon and the wiring of the household appliance is more reliable.

In any of the above embodiments, further, the rotational structure further comprises: a driving member, and the driving member and the fixed bracket are connected; and a first transmission member, and the first transmission member is connected to the driving member and the rotary bracket, respectively, the driving member being adapted to drive the first transmission member to rotate to link the rotary bracket to rotate.

In the embodiment, the driving member drives the first transmission member to rotate and the first transmission member drives the rotary bracket to rotate; it could be understood that the first transmission member rotates to link the rotary bracket to rotate, namely, the driving member drives the first transmission member to rotate; since the first transmission member is connected to the rotary bracket, the first transmission member can drive the rotary bracket to move, namely, the first transmission member rotation links the rotary bracket to rotate.

Specifically, the driving member comprises a motor, and the motor may be a synchronous motor or a stepping motor.

In any of the above embodiments, further, the fixed bracket comprises: a body portion, and the body portion is connected with the driving member and the second fixed seat; and a mounting post connected to the body portion, and the rotary bracket is sleeved on the mounting post, and the rotary bracket is adapted to rotate about the mounting post.

In the embodiment, the fixed bracket comprises a body portion and a mounting post, and the driving member is fixed on the body portion. Meanwhile, the rotational structure can also be fixed on other apparatuses via the body portion. The mounting post is provided on the body portion, and the rotary bracket is sleeved on the mounting post, to realize the rotation of the rotary bracket around the mounting post, and improve the reliability of the connection between the fixed bracket and the rotary bracket.

Specifically, the rotary bracket can rotate circumferentially around the fixed bracket. Sleeving the rotary bracket on the mounting post of the fixed bracket can reduce the size of the rotational structure.

In any of the above embodiments, further, the body portion has a mounting groove, and the first transmission member is provided on the mounting groove; a first through hole is provided on the wall surface of the mounting groove, the first through hole penetrates through the wall surface of the mounting groove, and the first transmission member is connected to the rotary bracket via the first through hole.

In this embodiment, the body portion has a mounting groove with the first transmission member provided within the mounting groove to avoid the exposure of the first transmission member to the outer side which affects the aesthetics of the rotational structure. The first transmission member is provided in the mounting groove, and in order to realize the connection between the first transmission member and the rotary bracket, a first through hole is provided in the wall surface of the mounting groove. This allows the first transmission member to be connected to the rotary bracket via the first through hole. It could be understood that the first through hole is a through hole penetrating through the wall surface of the mounting groove.

Specifically, the rotary bracket is sleeved on the outer side of the mounting groove.

In any of the above embodiments, further, the rotary bracket comprises: a connection portion, and the connection portion is sleeved on the mounting post, and one end of the connection portion away from the driving member is connected to the first fixed seat; and a second transmission member connected to the connection portion, and the first transmission member is connected to the second transmission member, and the first transmission member is adapted to drive the second transmission member to rotate to link the connection portion to rotate.

In this embodiment, the rotary bracket comprises a connection portion and a second transmission member which are connected. The connection portion is sleeved on the mounting post, the second transmission member is connected to the first transmission member, the driving member drives the first transmission member to rotate, and the first transmission member drives the second transmission member to rotate and the connection portion connected to the second transmission member rotates around the mounting post, i.e. the rotary bracket rotates around the fixed bracket.

In any of the above embodiments, further, the household appliance further comprises: a damper connected to the body portion and provided on the mounting groove, the damper including a third rotational member; and the second through hole is provided on the wall surface of the mounting groove, the second through hole penetrates through the wall surface of the mounting groove, and the third rotational member is connected to the second transmission member via the second through hole.

In this embodiment, the household appliance further includes a damper. The damper is mounted on the body portion and housed in the mounting groove. The damper comprises a third rotational member, and the third rotational member is connected to the second transmission member. When the rotational structure works, the driving member drives the first transmission member to rotate, the first transmission member drives the second transmission member to rotate, and the second transmission member drives the third rotational member to rotate. When the third rotational member rotates, a damping effect can be generated. That is to say, the kinetic energy of the rotation of the second transmission member is consumed when the third rotational member rotates and the kinetic energy of the rotation of the second transmission member is attenuated, and forming a damping effect. The damper ensures the stability of the rotational structure during working, and at the same time, when the rotary bracket is forcedly driven by an external force, the reliability of the rotational structure can be ensured by the damping effect of the damper.

In any of the above embodiments, Further, each of the first transmission member, the second transmission member, and the third rotational member comprises a gear structure, and the first transmission member and the second transmission member are drivingly engaged through a gear structure, and the second transmission member and the third rotational member are drivingly engaged through a gear structure.

In the embodiment, the first transmission member, the second transmission member, and the third rotational member all comprise a gear structure, and the first transmission member and the second transmission member are connected via the gear structure to realize a gear transmission and improve the reliability of the connection therebetween. The second transmission member and the third rotational member are connected via the gear structure to realize a gear transmission and improve the reliability of the connection therebetween.

In any of the above embodiments, further, the driving member comprises a rotor and an output shaft connected to the rotor, and the output shaft is connected to the first transmission member. The rotation axis of the rotor, the axis of the mounting post, and the axis around which the rotary bracket rotates are arranged coaxially, or the rotation axis of the rotor and the axis of the mounting post do not coincide.

In the embodiment, the driving member comprises an output shaft and a rotor, and the rotor rotates to drive the output shaft to rotate and the first connecting member is driven to rotate via the output shaft. The axis rotated by the rotor, the axis of the mounting post, and the axis around which the rotary bracket rotates are arranged coaxially and the space occupied by the rotational structure is reduced. Alternatively, the axis around which the rotor rotates and the axis of the mounting post do not coincide, i.e. the rotary bracket moves eccentrically with respect to the driving member and the rotational structure can be applied to different apparatuses depending on the actual situation.

In any of the above embodiments, further, the household appliance further comprises: a support bearing provided between the rotary bracket and the mounting post; a limiting member along the direction of the axis about which the rotary bracket rotates, the limiting member being located at one end of the rotary bracket away from the driving member; a friction plate, along the direction of the axis about which the rotary bracket rotates, the friction plate being arranged between the rotary bracket and the limiting member; and a limiting structure connected to the fixed bracket, the limiting structure being adapted to limit the rotation angle of the rotary bracket.

In the embodiment, the household appliance further comprises a support bearing. The support bearing is mounted inside the rotary bracket and nested on the mounting post for connecting the rotary bracket and the mounting post; the household appliance further comprises a limiting member, and the limiting member is arranged on the rotary bracket and is located at one end of the rotary bracket away from the driving member; at the same time, the limiting member is clamped on the fixed bracket, and defining the support bearing on the mounting post; the household appliance further comprises a friction plate mounted between the rotary bracket and the limiting member and being made of a wear-resistant and easy-to-wear material, which can achieve the control of the gap between the rotary bracket and the fixed bracket and stabilize the rotational structure; at the same time, the friction plate has a lubricating effect when the rotary bracket rotates. The fixed bracket is further provided with a limiting structure thereon, and the limiting structure can limit the rotary bracket to fix the rotated rotary bracket after rotation in a specified position.

In any of the above embodiments, further, the household appliance includes any one of the fan, air conditioner, and heater.

In this embodiment, the household appliance comprises any one of the fan, air conditioner, or heater. Specifically, when the household appliance is a fan, the mounting portion is a support structure, the rotational portion is a fan head, and the axis around which the rotary bracket rotates in the rotational structure is perpendicular to the length direction of the support structure and the fan head can rotate up and down, namely, the adjustment of the pitch angle of the fan head is realized.

The embodiments of the present disclosure will become apparent in the following description, or be understood through the practice of the present disclosure.

BRIEF DESCRIPTION OF THE DRAWINGS

The foregoing and/or additional embodiments of the present disclosure will become apparent and readily appreciated from the following description of the embodiments, taken in conjunction with the accompanying drawings of which.

Figure 1:
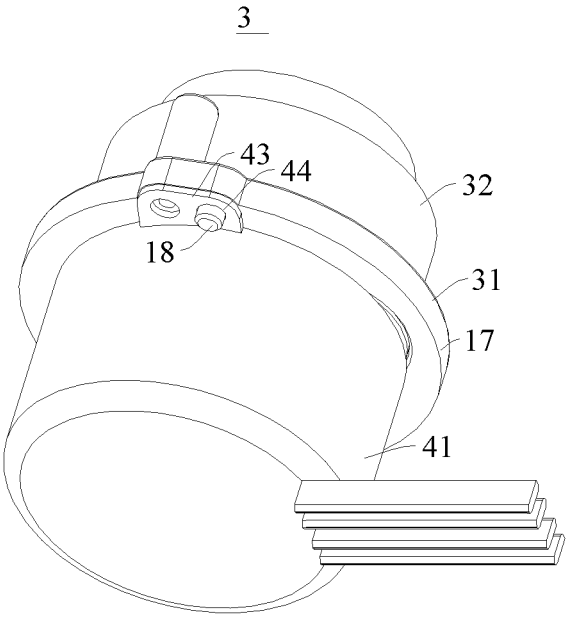
FIG. 1 is a schematic view of a first specific embodiment of a rotation driving mechanism according to an embodiment of the present disclosure.
Figure 2:
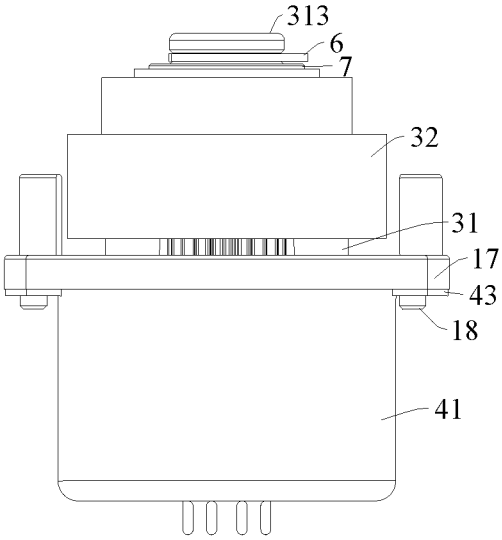
FIG. 2 is a side view of a first specific embodiment of a rotation driving mechanism according to an embodiment of the present disclosure.

The corresponding relations between the reference numerals and the component names in FIGS. 1 to 23 are:

100 household appliance, 10 air supply apparatus, 1 first fixed seat, 2 second fixed seat, 3 rotation driving mechanism, 31 fixed bracket, 311 body portion, 312 mounting groove, 313 mounting post, 314 first through hole, 315 second through hole, 16 positioning groove, 17 first mounting portion, 18 first positioning portion, 19 reinforcing structure, 32 rotary bracket, 321 second transmission member, 322 through-hole, 323 annular boss, 324 damping mechanism connection structure, 325 first routing channel, 326 stopper boss, 22 fitting groove, 23 third through hole, 4 driving assembly, 41 driving member, 42 first transmission member, 43 second mounting portion, 44 second positioning portion, 5 support bearing, 51 bearing inner ring stop, 52 bearing outer ring stop, 6 snap spring, 7 friction plate, 8 damper, 9 Hall assembly, 91 Hall plate, 92 magnet, 93 damping mechanism, 94 second routing channel, 20 handpiece, 112 first damping frame, and 114 second damping frame.

DETAILED DESCRIPTION OF THE DISCLOSURE

Embodiments of the present disclosure may be more clearly understood, a more particular description of the present disclosure will be further described in detail with reference to the accompanying drawings and specific implementation modes. It should be noted that the embodiments and features of the embodiments of the present disclosure can be combined with each other without conflict.

In the following description, numerous specific details are set forth in order to provide a thorough understanding of the present disclosure. However, the present disclosure may be implemented otherwise than as specifically described herein. Accordingly, the scope of the present disclosure is not limited by the specific embodiments disclosed below.

A rotation driving mechanism 3, an air supply apparatus 10, and a household appliance 100 of an air supply apparatus according to some embodiments of the present disclosure are described below with reference to FIGS. 1 to 23.

As shown in FIGS. 1 to 7, according to the rotation driving mechanism 3 of the first specific embodiment of the present disclosure, the rotation driving mechanism 3 is connected to a rotary component of the air supply apparatus, and the rotation driving mechanism 3 is used for driving the rotary component to rotate. The rotation driving mechanism 3 includes: a fixed bracket 31, a rotary bracket 32, and a driving member 41. The driving member 41 may be set to be a driving motor, and the driving motor may be a synchronous motor or a stepping motor. The fixed bracket 31 is fixedly arranged on a support structure of the air supply apparatus, the rotary bracket 32 being sleeved on the fixed bracket 31. It can also be understood that the rotary bracket 32 is sleeved on the outer side of the fixed bracket 31, and the rotary bracket 32 is rotatable with respect to the fixed bracket 31; the rotary bracket 32 is connected to the rotary component of the air supply apparatus; the rotary bracket 32 can rotate with the rotary component; the driving member 41 is arranged on the fixed bracket 31; the driving member 41 is used for driving the rotary bracket 32 to rotate with respect to the fixed bracket 31.

Specifically, when the rotation driving mechanism 3 drives the rotary component of the air supply apparatus to rotate, the driving member 41 drives the rotary bracket 32 to make a predetermined trajectory rotation with respect to the fixed bracket 31, and the rotary bracket 32 can move together with the rotary component of the air supply apparatus during the rotation, and achieving the working purpose of the rotation of the rotary component of the air supply apparatus. The size of the rotation driving mechanism 3 of the present disclosure is smaller than a crank and rocker mechanism of the prior art, and such an arrangement can reduce the size of the rotation driving mechanism 3. After the rotation driving mechanism 3 is mounted on the air supply apparatus, the air supply apparatus can be made to look more compact, and the air supply apparatus can be made more pleasing to the eye. The rotation angle range of the rotary bracket 32 with respect to the fixed bracket 31 is 0° to 360°, namely, the rotary bracket 32 moves with respect to the fixed bracket 31 over the entire circumference. The rotation of rotary bracket 32 has no limiting position and the rotation angle of the rotary bracket 32 with respect to the fixed bracket 31 can be made unlimited, and the shaking angle of the rotary component of the air supply apparatus can be enlarged and the air supply range of the air supply apparatus can be enlarged.

Therefore, with the coordination of the fixed bracket 31, the rotary bracket 32, and the driving member 41, the size of the rotation driving mechanism 3 can be reduced as compared with the prior art. The air supply apparatus can be made more pleasing to the eye after the rotation driving mechanism 3 is mounted on the air supply apparatus, and the rotation angle of the rotary bracket 32 with respect to the fixed bracket 31 is not limited, and the shaking angle of the rotary component of the air supply apparatus can be enlarged.

Figure 3:
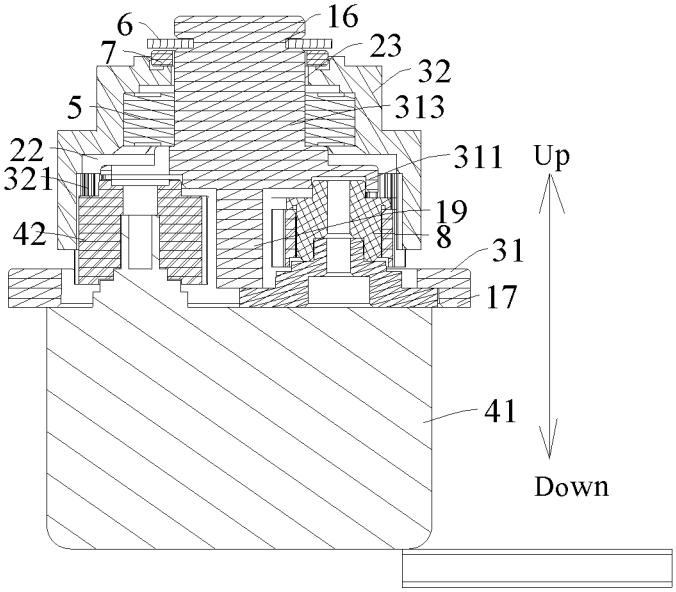
FIG. 3 is a cross-sectional view of a first specific embodiment of a rotation driving mechanism according to an embodiment of the present disclosure.
Figure 4:
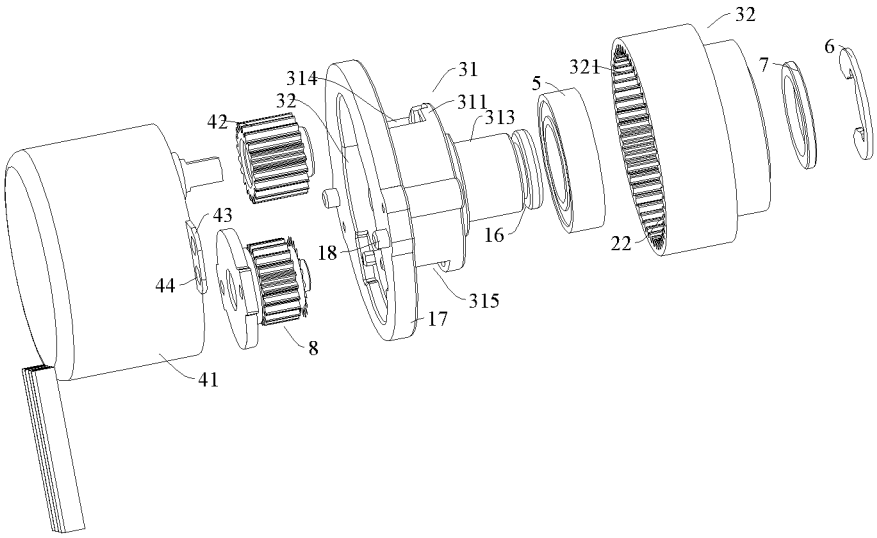
FIG. 4 is an exploded view of a first specific embodiment of a rotation driving mechanism according to an embodiment of the present disclosure.

In some embodiments of the present disclosure, as shown in FIGS. 3 and 4, the rotation driving mechanism 3 may further include: a first transmission member 42, and the rotary bracket 32 is provided with a second transmission member 321 drivingly mating with the first transmission member 42, the first transmission member 42 being connected to the driving shaft of the driving member 41. When the driving member 41 is working, the driving member 41 drives the driving shaft to rotate, and the driving shaft carries the first transmission member 42 to rotate. Meanwhile, the first transmission member 42 transmits power to the second transmission member 321, and then the second transmission member 321 drives the rotary bracket 32 to rotate to achieve the working effect of driving the rotary bracket 32 to rotate with respect to the fixed bracket 31.

In some embodiments of the present disclosure, as shown in FIGS. 3 and 4, the first transmission member 42 may be provided as a gear, and the second transmission member 321 may be provided as a rack. After the rotation driving mechanism 3 is mounted, the gear is engaged with the rack, and the power of the driving member 41 can be transmitted to the rotary bracket 32 via the transmission between the gear and the rack and the rotary bracket 32 rotates. Furthermore, through the coordinated transmission of the gear and the rack, the power can be smoothly transmitted to the rotary bracket 32 to smoothly rotate the rotary bracket 32, and making the arrangement of the first transmission member 42 and the second transmission member 321 more reasonable and making the rotary component of air supply apparatus rotates more smoothly.

Figure 5:
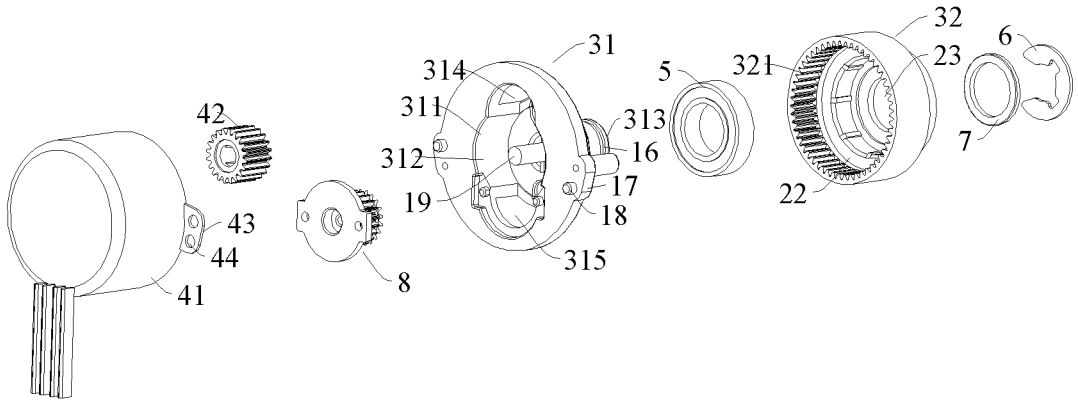
FIG. 5 is exploded view from another angle of a first specific embodiment of a rotation driving mechanism according to an embodiment of the present disclosure.

In some embodiments of the present disclosure, as shown in FIGS. 4 and 5, the fixed bracket 31 may include: a body portion 311, and the body portion 311 defines a mounting groove 312, the side wall of the mounting groove 312 has a first through hole 314, the first through hole 314 communicates with the mounting groove 312, the first transmission member 42 is located in the mounting groove 312, and the first transmission member 42 drivingly mates with the second transmission member 321 via the first through hole 314. A part of the structure of the first transmission member 42 is located in the mounting groove 312, and another part of the structure of the first transmission member 42 is engaged with the second transmission member 321 after extending out of the first through hole 314 and the first transmission member 42 and the second transmission member 321 drivingly mate. At that, the power transmission from the driving member 41 to the rotary bracket 32 can be ensured, and the size of the rotation driving mechanism 3 can be further reduced compared with the prior art.

In some embodiments of the present disclosure, as shown in FIGS. 4 and 5, the second transmission member 321 may be arranged at the inner wall surface of the rotary bracket 32 opposite to the fixed bracket 31. Such arrangement facilitates the driving mating between the second transmission member 321 and the first transmission member 42 and the size of the rotation driving mechanism 3 can be better reduced. Therefore, the arrangement position of the second transmission member 321 may be more reasonable.

In some embodiments of the present disclosure, as shown in FIGS. 3 to 5, the rotation driving mechanism 3 may further comprise: a damper 8, and the damper 8 can be a damper, the side wall of the mounting groove 312 can have a second through hole 315, the damper 8 can be provided on the fixed bracket 31 and located in the mounting groove 312, and the damper 8 drivingly mates with the second transmission member 321 via the second through hole 315. A part of the structure of the damper 8 is located in the mounting groove 312, and another part of the structure of the damper 8 extends out of the second through hole 315 and then engages with the second transmission member 321; the damper 8 has a buffering function; during the rotation of the rotary bracket 32, the rotary bracket 32 can be kept rotating stably by the damper 8 coordinating with the second transmission member 321; when the rotary bracket 32 is forced to rotate driven by an external force, the rotation driving mechanism 3 can be prevented from being damaged. It needs to be noted that dampers 8 with different specification structures can be used according to actual conditions.

Further, multiple dampers 8 and multiple second through holes 315 may be provided, and multiple dampers 8 and multiple second through holes 315 are provided in a one-to-one correspondence and stable rotation of the rotary bracket 32 can be better kept, and the damage to the rotation driving mechanism 3 can be better prevented when the rotary bracket 32 is forced to rotate by being driven by an external force.

In some embodiments of the present disclosure, as shown in FIG. 3, the rotation driving mechanism 3 may further comprise: a support bearing 5, and the support bearing 5 is supported between the fixed bracket 31 and the rotary bracket 32, and the fixed bracket 31 and the rotary bracket 32 can be better assembled together, and when the rotary bracket 32 rotates, it can ensure that the rotary bracket 32 rotates smoothly with respect to the fixed bracket 31; the support bearing 5 has a supporting effect on the rotary bracket 32, and can avoid the rotary bracket 32 from shaking.

In some embodiments of the present disclosure, as shown in FIGS. 3 and 4, the outer wall surface of the bottom wall of the mounting groove 312 can be provided with a mounting post 313, the inner ring of the support bearing 5 can be sleeved on the outer surface of the mounting post 313, the inner ring of the support bearing 5 is connected to the mounting post 313, and the outer ring of the support bearing 5 is connected to the rotary bracket 32. Such arrangement can ensure that the rotary bracket 32 and the fixed bracket 31 can rotate with respect to each other, and can ensure the working performance of the rotation driving mechanism 3.

In some embodiments of the present disclosure, as shown in FIG. 3, the inner wall surface of the bottom wall of the mounting groove 312 may be provided with a reinforcing structure 19. The reinforcing structure 19 is integrally formed with the mounting post 313 and the structural strength of the fixed bracket 31 may be improved and the deformation of the fixed bracket 31 may be avoided.

In some embodiments of the present disclosure, as shown in FIGS. 3 and 4, the rotation driving mechanism 3 may further include: a friction plate 7, and the rotary bracket 32 can define a fitting groove 22, the support bearing 5 is located in the fitting groove 22, and the bottom wall of the fitting groove 22 can be provided with a third through hole 23; the free end of the mounting post 313 extends out of the third through hole 23, the friction plate 7 can be sleeved on the outer surface of the mounting post 313, and the friction plate 7 abuts against the outer end of the third through hole 23; the friction plate 7 has wear-resistant and easy-to-wear properties; by providing the friction plate 7, the gap between the rotary bracket 32 and the fixed bracket 31 can be controlled, and the structure of the rotation driving mechanism 3 can be made more stable, and the friction plate 7 can provide a lubricating effect when the rotary bracket 32 rotates. Therefore, the rotation of the rotary bracket 32 can be facilitated, and further, the rotational noise of the rotary bracket 32 can be reduced.

In some embodiments of the present disclosure, as shown in FIGS. 3 and 4, the rotation driving mechanism 3 may further include: a snap spring 6, and the circumferential wall surface of the mounting post 313 can be provided with a positioning groove 16, the positioning groove 16 is arranged along the circumferential direction of the mounting post 313, and the snap spring 6 is provided in the positioning groove 16; the snap spring 6 abuts against the end surface of the friction plate 7 away from the third through hole 23, as shown in FIG. 3, and the snap spring 6 abuts against the upper end surface of the friction plate 7; since the support bearing 5 is tightly mated with the rotary bracket 32, the support bearing 5 and the rotary bracket 32 can be reliably locked on the mounting post 313 of the fixed bracket 31 by providing the snap spring 6, and making the structural mounting of the rotation driving mechanism 3 more stable.

In some embodiments of the present disclosure, as shown in FIGS. 3 and 4, the edge of the open end of the mounting groove 312 may be provided with a first mounting portion 17, and the driving member 41 may be provided with a second mounting portion 43 connected to the first mounting portion 17, and the driving member 41 can be fixed on the fixed bracket 31 by mating the first mounting portion 17 and the second mounting portion 43 for connection and the driving member 41 can be prevented from falling off the fixed bracket 31.

In some embodiments of the present disclosure, as shown in FIGS. 3 and 4, the first mounting portion 17 may be provided with a first positioning portion 18, and the second mounting portion 43 may be provided with a second positioning portion 44 connected to the first positioning portion 18. The first positioning portion 18 can be provided as a positioning post, and the second positioning portion 44 can be provided as a positioning hole; when mounting the driving member 41 and the fixed bracket 31, the positioning post is firstly inserted into the positioning hole and the relative positions of the driving member 41 and the fixed bracket 31 can be positioned; then, the driving member 41 and the fixed bracket 31 are assembled together by using a bolt and the assembly of the driving member 41 and the fixed bracket 31 is facilitated, and the assembly efficiency of the rotation driving mechanism 3 can be improved.

In some embodiments of the present disclosure, the rotation driving mechanism 3 may further comprise: a hall assembly (not shown in the figure), and the Hall assembly may comprise a Hall plate and a magnet, one of the Hall plate and magnet is provided on the fixed bracket 31, and the other of the Hall plate and magnet is provided on the rotary bracket 32. When the rotary bracket 32 needs to rotate by a specified angle with respect to the fixed bracket 31, the Hall plate and the magnet can work coordinatingly to achieve the purpose of controlling the rotary bracket 32 to rotate by a specified angle and the rotation driving mechanism 3 can meet different working requirements of a user.

In some embodiments of the present disclosure, the fixed bracket 31 may be provided with a first limiting structure (not shown in the figure), and the rotary bracket 32 may be provided with a second limiting structure (not shown in the figure) coordinating with the first limiting structure in limiting. When the rotary bracket 32 needs to rotate the specified angle with respect to the fixed bracket 31, the first limiting structure and the second limiting structure coordinate to work and the working purpose of controlling the rotary bracket 32 to rotate the specified angle can be achieved. Therefore, the rotation driving mechanism 3 can be made to meet the different working requirements of a user.

In some embodiments of the present disclosure, as shown in FIG. 3, the central axis of the driving member 41, the central axis of the fixed bracket 31, and the central axis of the rotary bracket 32 are arranged to coincide. Such arrangement can further reduce the size of the rotation driving mechanism 3 in a direction perpendicular to the central axis, and can make the structure of the rotation driving mechanism 3 more compact.

Figure 6:
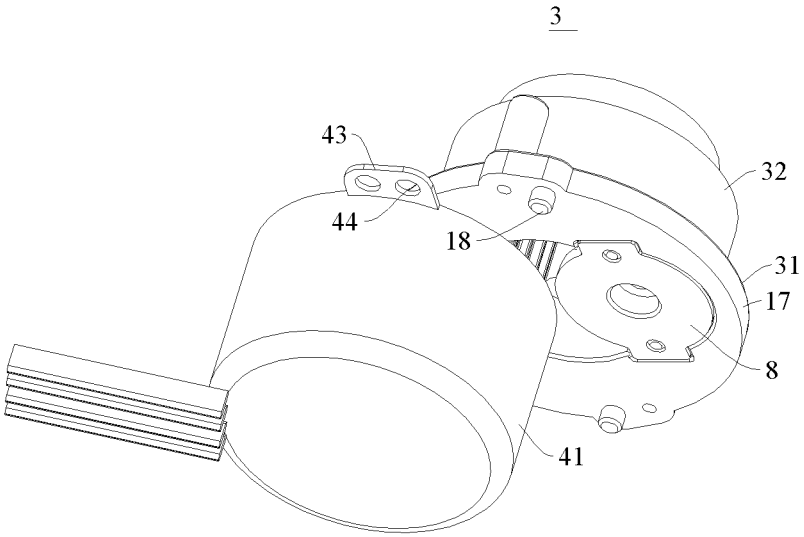
FIG. 6 is a schematic view of a second specific embodiment of a rotation driving mechanism according to an embodiment of the present disclosure.
Figure 7:
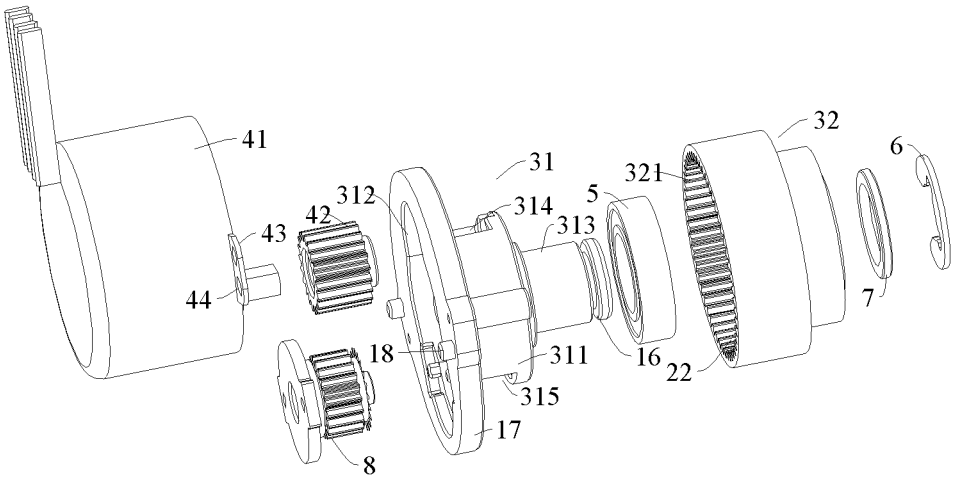
FIG. 7 is an exploded view of a second specific embodiment of a rotation driving mechanism according to an embodiment of the present disclosure.

As shown in FIGS. 6 and 7, a rotation driving mechanism 3 according to a second specific embodiment of the present disclosure is shown. In this embodiment, differing from the first specific embodiment, the central axis of the fixed bracket 31 and the central axis of the rotary bracket 32 coincide, and the central axis of the driving member 41 and the central axis of the fixed bracket 31 do not coincide. By adjusting the position of driving member 41 with respect to fixed bracket 31, the eccentric movement of the rotary bracket 32 and the driving member 41 is realized, which has a wider usage scenario.

According to the air supply apparatus of the embodiments of the present disclosure, including the rotation driving mechanism 3 of the above-mentioned embodiments, the rotation driving mechanism 3 is arranged on the air supply apparatus and the rotation driving mechanism 3 can reduce the size of the rotation driving mechanism 3; after the rotation driving mechanism 3 is mounted on the air supply apparatus, the air supply apparatus can be more pleasing to the eye, and the rotary bracket 32 has no limitation with respect to the rotation angle of the fixed bracket 31, and the shaking angle of the rotary component of the air supply apparatus can be enlarged.

The following describes the air supply apparatus 10 according to an embodiment of the present disclosure with reference to FIGS. 8 to 14. The air supply apparatus 10 may be an appliance having a pitch function, such as a fan, a heater NPS-Q, etc.

As shown in FIGS. 8 to 14, according to an air supply apparatus 10 of an embodiment of the present disclosure, a fan is taken as an example for illustrating the air supply apparatus 10. The air supply apparatus 10 comprises: a first fixed seat 1, a second fixed seat 2, and a rotation driving mechanism 3. The second fixed seat 2 is connected to the handpiece 20 of the air supply apparatus 10, namely, the second fixed seat 2 is connected to the handpiece 20 of the fan. The first fixed seat 1 is used for supporting the rotation driving mechanism 3; the rotation driving mechanism 3 has a fixed bracket 31 and a rotary bracket 32, and the fixed bracket 31 is fixedly connected to the first fixed seat 1, the rotary bracket 32 is fixedly connected to the second fixed seat 2, the rotary bracket 32 is sleeved over the outer side of the fixed bracket 31, and the rotation driving mechanism 3 further has a driving assembly 4, the driving assembly 4 being adapted to drive the rotary bracket 32 to rotate around the pitch axis.

It needs to be noted that the pitch axis can be arranged in parallel with the horizontal plane. When the driving assembly 4 drives the rotary bracket 32 to rotate around the pitch axis, the second fixed seat 2 will rotate around the pitch axis together with the rotary bracket 32 and the handpiece 20 of the air supply apparatus 10 can rotate in an up-and-down direction. At that, the pitching action of the handpiece 20 of the fan can be achieved.

Specifically, when it is required that the handpiece 20 of the air supply apparatus 10 rotates in the up-and-down direction, the driving assembly 4 drives the rotary bracket 32 to rotate around the pitch axis. When the rotary bracket 32 rotates, the second fixed seat 2 rotates around the pitch axis. When the second fixed seat 2 rotates around the pitch axis, the handpiece 20 rotates together in the up-and-down direction, to achieve the working purpose of the pitching action of the handpiece 20 of the air supply apparatus 10. By sleeving the rotary bracket 32 on the outer side of the fixed bracket 31, the size of the rotation driving mechanism 3 can be reduced compared with the four-linkage mechanism in the prior art. After the air supply apparatus 10 is assembled, the size of the air supply apparatus 10 can be reduced and the air supply apparatus 10 can be made more pleasing to the eye and more delicate, and improving the market competitiveness of the air supply apparatus 10.

Therefore, through the coordination of the first fixed seat 1, the second fixed seat 2, and the rotation driving mechanism 3, the size of rotation driving mechanism 3 can be reduced compared with the prior art. After the air supply apparatus 10 is assembled, the air supply apparatus 10 can be made more pleasing to the eye, and improving the market competitiveness of the air supply apparatus 10.

Figure 8:
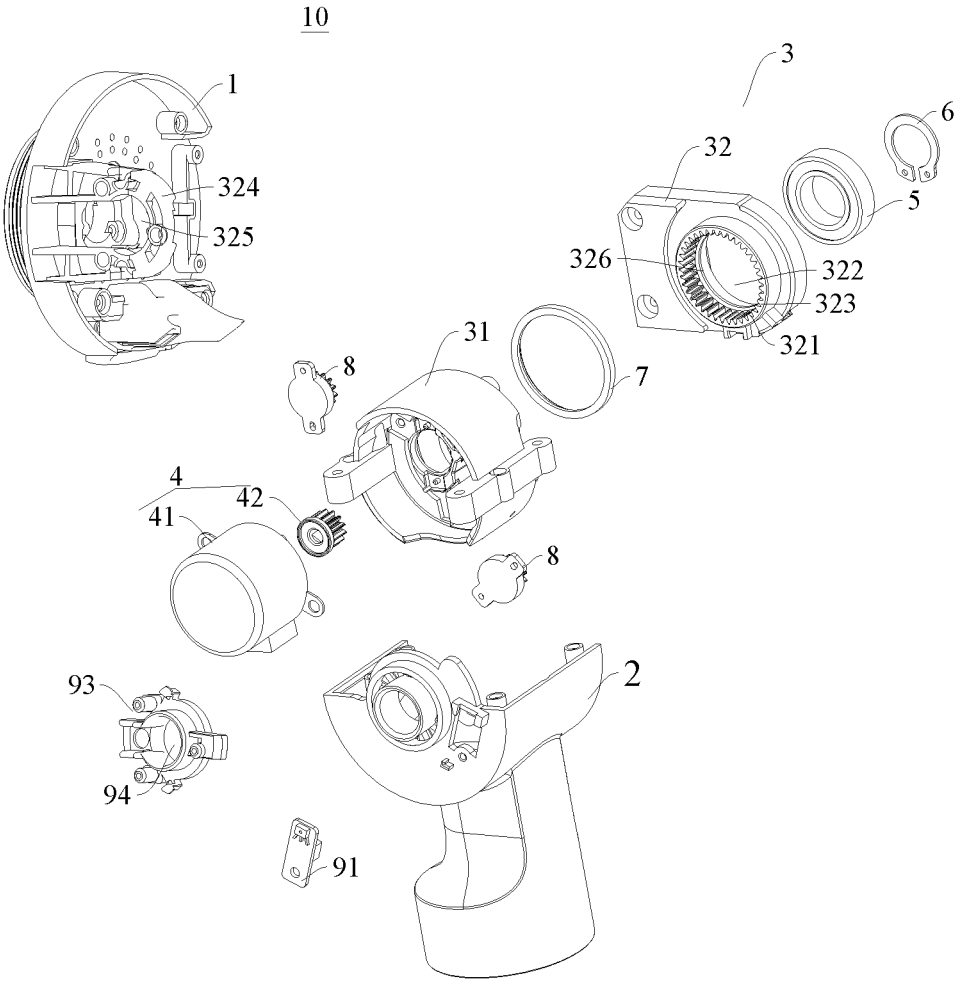
FIG. 8 is an exploded view of an air supply apparatus's first fixed seat and second fixed seat, and a rotation driving mechanism of a first embodiment according to an embodiment of the present disclosure.

In some embodiments of the present disclosure, as shown in FIG. 8, the driving assembly 4 may include: a driving member 41 and a first transmission member 42, the first transmission member 42 being connected to the driving member 41. It needs to be noted that the driving member 41 can be provided as a driving motor, the first transmission member 42 is connected to the output shaft of the driving motor, and the rotary bracket 32 can be provided with a second transmission member 321 engaging with the first transmission member 42 for transmission. The driving motor can provide power for the rotation of the rotary bracket 32; when the driving member 41 works, the driving member 41 drives the output shaft to rotate, and the output shaft rotates with the first transmission member 42; at the same time, the first transmission member 42 transmits power to the second transmission member 321; and then the second transmission member 321 drives the rotary bracket 32 to rotate around the pitch axis, to achieve the working effect of driving the second fixed seat 2 to rotate with respect to the first fixed seat 1.

In some embodiments of the present disclosure, as shown in FIG. 8, the first transmission member 42 may be provided as a gear, and the second transmission member 321 may be provided as a rack. After the rotation driving mechanism 3 is mounted, the gear and the rack are engaged together. The power of the driving member 41 can be transmitted to the rotary bracket 32 through gear and rack transmission and the rotary bracket 32 rotates. Furthermore, through the coordinated transmission of the gear and the rack, the power can be smoothly transmitted to the rotary bracket 32 and the rotary bracket 32 smoothly rotates around the pitch axis, and therefore, the arrangement of the first transmission member 42 and the second transmission member 321 can be more reasonable, and the handpiece 20 of the air supply apparatus 10 can also rotate more smoothly.

Figure 14:
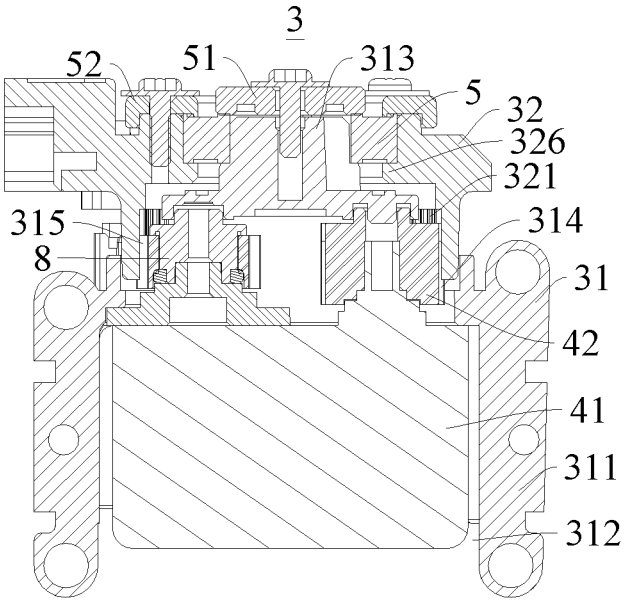
FIG. 14 is a cross-sectional view of a rotation driving mechanism of a second embodiment of an air supply apparatus according to an embodiment of the present disclosure.
Figure 15:
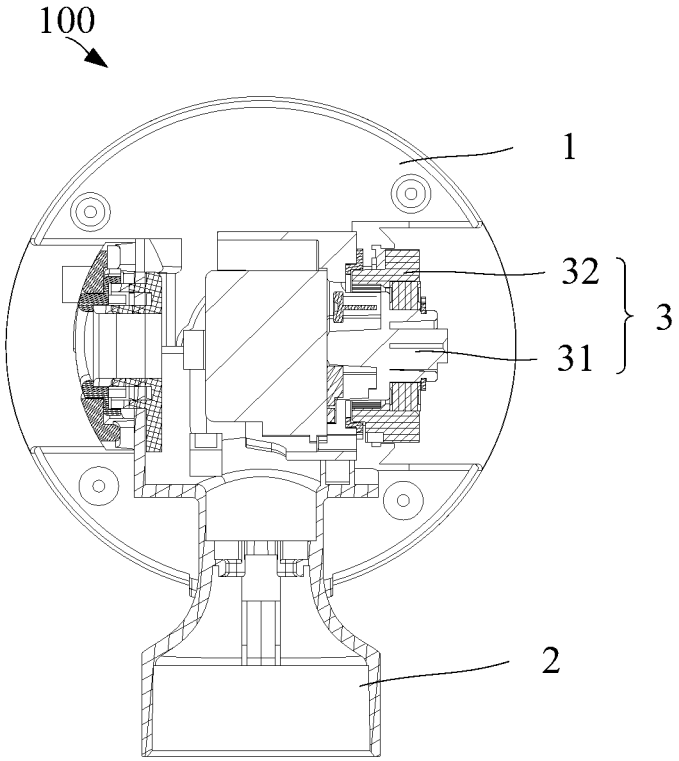
FIG. 15 is a cross-sectional view of a household appliance according to one embodiment of the present disclosure.

In some embodiments of the present disclosure, as shown in FIGS. 8 and 14, the rotation driving mechanism 3 may further include: a support bearing 5, and the fixed bracket 31 may comprise a body portion 311, the body portion 311 may define a mounting groove 312, and the outer wall surface of the bottom wall of the mounting groove 312 may be provided with a mounting post 313; the inner ring of the support bearing 5 is sleeved on the outer side of the mounting post 313, and the outer ring of the support bearing 5 is connected to the rotary bracket 32 and the fixed bracket 31 and the rotary bracket 32 can be better assembled together. When the rotary bracket 32 rotates, it is ensured that the rotary bracket 32 rotates smoothly with respect to the fixed bracket 31, and the support bearing 5 plays a supporting function on the rotary bracket 32 to prevent the rotary bracket 32 from shaking. It can also ensure that the rotary bracket 32 can rotate with respect to the fixed bracket 31, and can ensure the working performance of the rotation driving mechanism 3.

In some embodiments of the present disclosure, as shown in FIG. 8, the rotary bracket 32 may define a through-hole 322, the through-hole 322 penetrates through the rotary bracket 32 in the thickness direction of the rotary bracket 32, and the through-hole 322 is sleeved on the outer side of the fixed bracket 31 and the support bearing 5, and the working purpose of the rotary bracket 32 sleeved on the fixed bracket 31 can be achieved. The air supply apparatus 10 can be assembled smoothly, and the connection of the rotary bracket 32 to the outer ring of the support bearing 5 can also be facilitated.

In some embodiments of the present disclosure, as shown in FIG. 8, the inner wall surface of the through-hole 322 may be provided with an annular boss 323, and the inner wall surface of the annular boss 323 may be provided with a second transmission member 321, i.e., the inner wall surface of the annular boss 323 may be provided with a rack, and the rack may be arranged to extend along the thickness direction of the rotary bracket 32. Such arrangement ensures that the second transmission member 321 may engage with the first transmission member 42 and that the driving member 41 may drive the rotary bracket 32 to rotate.

Figure 10:
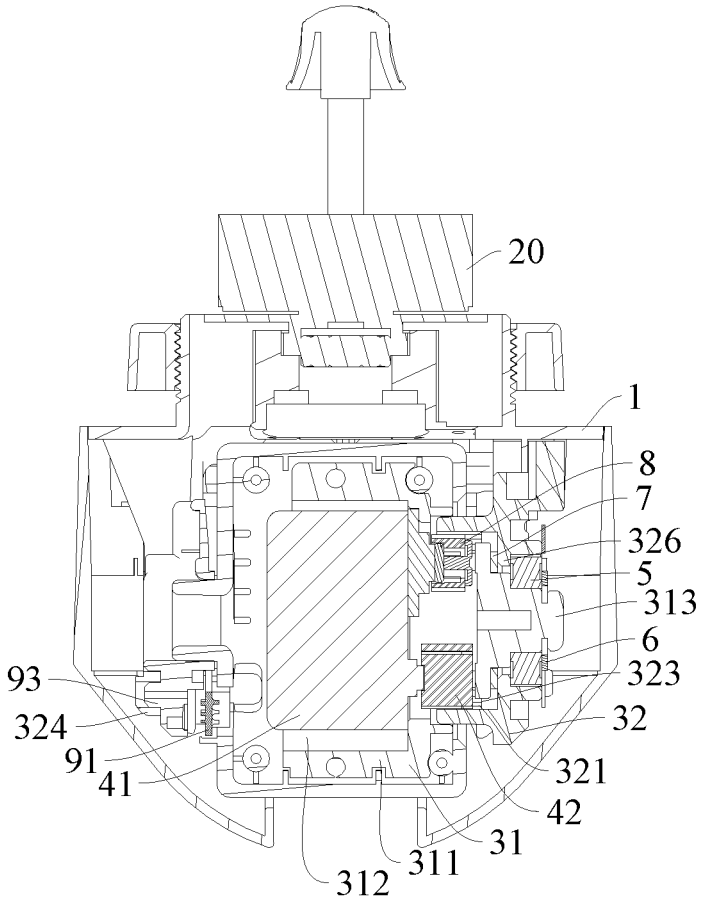
FIG. 10 is cross-sectional view from another angle of an air supply apparatus's first fixed seat and second fixed seat, and a rotation driving mechanism of a first embodiment according to an embodiment of the present disclosure.
Figure 11:
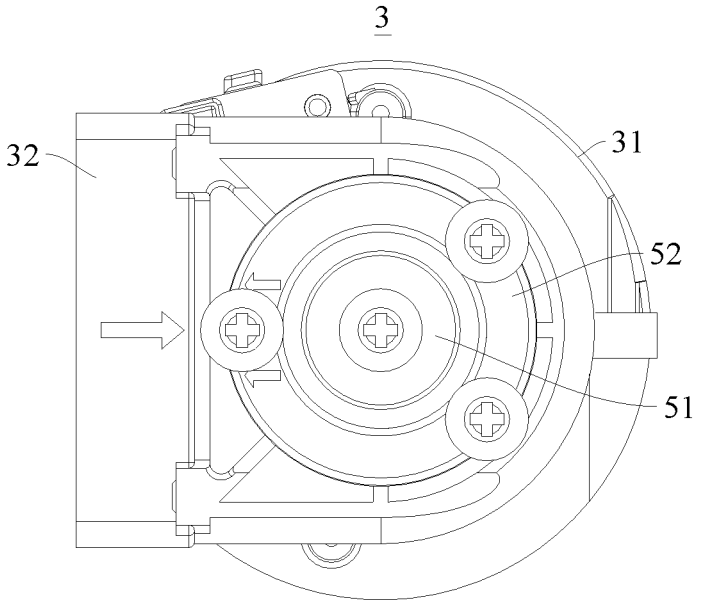
FIG. 11 is a side view of a rotation driving mechanism of a second embodiment of an air supply apparatus according to an embodiment of the present disclosure.
Figure 12:
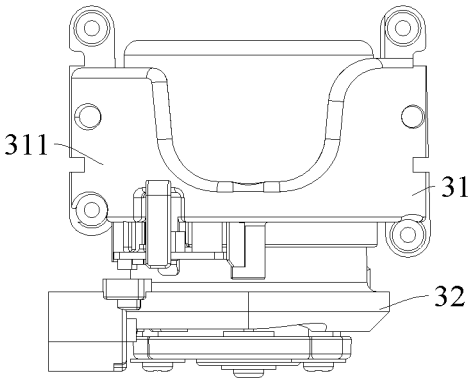
FIG. 12 is a top view of a rotation driving mechanism of a second embodiment of an air supply apparatus according to an embodiment of the present disclosure.

In some embodiments of the present disclosure, as shown in FIGS. 8, 10, and 14, the inner wall surface of the through-hole 322 is provided with a stopper boss 326, the stopper boss 326 is located between the annular boss 323 and the support bearing 5, and the stopper boss 326 abuts the support bearing 5. After the rotation driving mechanism 3 is assembled, the stopper boss 326 abuts the support bearing 5, and the support bearing 5 can limit the stopper boss 326 and prevent the rotary bracket 32 from separating from the fixed bracket 31. Therefore, the assembly reliability of the rotation driving mechanism 3 can be ensured, and therefore, the working reliability of the rotation driving mechanism 3 can be ensured.

In some embodiments of the present disclosure, as shown in FIG. 8, the rotation driving mechanism 3 may further include: a snap spring 6, and the snap spring 6 is sleeved on the outer side of the mounting post 313, and the snap spring 6 is located at the end of the support bearing 5 away from the fixed bracket 31. The circumferential wall surface of the mounting post 313 may be provided with a positioning groove, the positioning groove is arranged along the circumferential direction of the mounting post 313, the snap spring 6 is provided in the positioning groove, and the snap spring 6 abuts one end of the support bearing 5 away from the fixed bracket 31. By providing the snap spring 6, the support bearing 5 and the rotary bracket 32 can be reliably mounted on the rotary bracket 32, and the structural mounting of the rotation driving mechanism 3 can be made more reliable.

Figure 13:
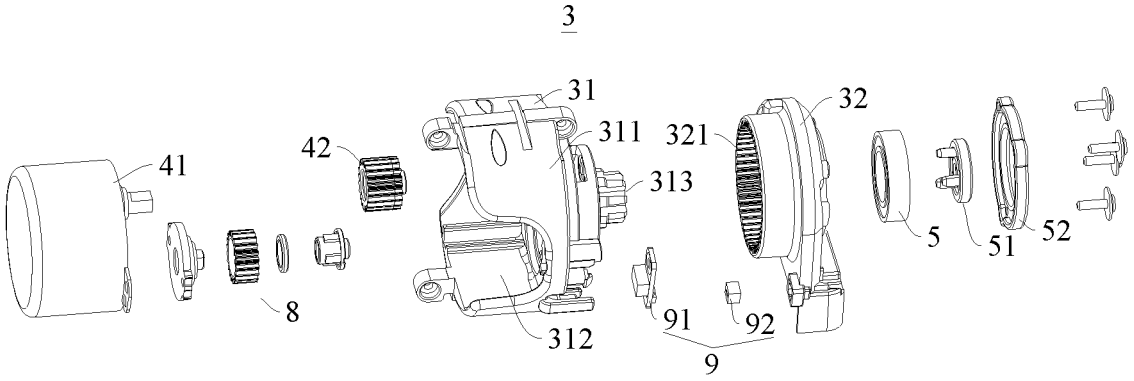
FIG. 13 is an exploded view of a rotation driving mechanism according to a second embodiment of an air supply apparatus according to an embodiment of the present disclosure.

In some embodiments of the present disclosure, as shown in FIGS. 13 and 14, the rotation driving mechanism 3 may further include: a bearing inner ring stop 51, and the bearing inner ring stop 51 may be provided on the fixed bracket 31, and the bearing inner ring stop 51 is located at one end of the support bearing 5 away from the fixed bracket 31. The bearing inner ring stop 51 can be connected to the fixed bracket 31 via a bolt. After the mounting of the rotation driving mechanism 3 is completed, the bearing inner ring stop 51 abuts one end of the support bearing 5 away from the fixed bracket 31 and the support bearing 5 can be reliably mounted on the fixed bracket 31, and the support bearing 5 can be prevented from falling off the mounting post 313.

In some embodiments of the present disclosure, as shown in FIGS. 13 and 14, the rotation driving mechanism 3 may further include: a bearing outer ring stop 52, and bearing outer ring stop 52 may be provided on the rotary bracket 32 and the bearing outer ring stop 52 is located at one end of the support bearing 5 away from the fixed bracket 31. The bearing outer ring stop 52 can be connected to the rotary bracket 32 via a bolt. After the rotation driving mechanism 3 is mounted, the bearing outer ring stop 52 abuts one end of the support bearing 5 away from the fixed bracket 31, which can further prevent the support bearing 5 from falling off the mounting post 313 and the support bearing 5 can be reliably mounted on the fixed bracket 31. Further, the support bearing 5 can be reliably supported between the fixed bracket 31 and the rotary bracket 32.

In some embodiments of the present disclosure, as shown in FIG. 8, the rotation driving mechanism 3 may further comprise: an annular friction plate 7, the friction plate 7 being made of wear-resistant and easy-to-wear materials. The body portion 311 is sleeved on the outer side of the friction plate 7, and the friction plate 7 is sleeved on the outer side of the rotary bracket 32. By providing the friction plate 7, it is possible to control the gap between the fixed bracket 31 and the rotary bracket 32, it is possible to make the structure of the rotation driving mechanism 3 more stable, and it is also possible to ensure that the rotary bracket 32 is rotatable with respect to the fixed bracket 31. The friction plate 7 can provide a lubricating effect when the rotary bracket 32 rotates, and facilitating the rotation of the rotary bracket 32 and reducing the rotational noise of the rotary bracket 32.

It needs to be noted that the rotation driving mechanism 3 of the first embodiment of the present disclosure differs from the rotation driving mechanism 3 of the second embodiment of the present disclosure in that the friction plate 7 is not provided in the rotation driving mechanism 3 of the second embodiment. The rotation driving mechanism 3 of the first embodiment limits the support bearing 5 via the snap spring 6, and the rotation driving mechanism 3 of the second embodiment limits the support bearing 5 via the bearing outer ring stop 52 and the bearing inner ring stop 51.

In some embodiments of the present disclosure, as shown in FIG. 14, the side wall of the mounting groove 312 may have a first through hole 314, the first through hole 314 being in communication with the mounting groove 312. Both the driving member 41 and the first transmission member 42 may be located in the mounting groove 312, and part of the structure of the first transmission member 42 passes through the first through hole 314 and then drivingly mates with the second transmission member 321. A part of the structure of the first transmission member 42 is located in the mounting groove 312, and another part of the structure of the first transmission member 42 is engaged with the second transmission member 321 after extending out of the first through hole 314 and the first transmission member 42 and the second transmission member 321 drivingly engage to coordinate. At that, the power transmission from the driving member 41 to the rotary bracket 32 can be ensured, and the size of the rotation driving mechanism 3 can be further reduced compared with the prior art. In addition, the gear and the rack have high transmission accuracy and can precisely control the pitch angle of a handpiece 20 of a fan.

In some embodiments of the present disclosure, as shown in FIGS. 8 and 14, the rotation driving mechanism 3 may further include: a damper 8, and the side wall of the mounting groove 312 may have a second through hole 315, and the damper 8 may be arranged in the mounting groove 312, and a part of the structure of the damper 8 passes through the second through hole 315 and then drivingly mates with the second transmission member 321. A part of the structure of the damper 8 is located in the mounting groove 312, and another part of the structure of the damper 8 extends out of the second through hole 315 and then engages with the second transmission member 321; the damper 8 has a buffering function; during the rotation of the rotary bracket 32, the rotary bracket 32 can be kept rotating stably by the damper 8 drivingly engaging with the second transmission member 321; when the rotary bracket 32 is forced to rotate driven by an external force, the rotation driving mechanism 3 can be prevented from being damaged. It needs to be noted that dampers 8 with different specification structures can be used according to actual conditions.

In some embodiments of the present disclosure, as shown in FIG. 13, the rotation driving mechanism 3 further includes: a Hall assembly 9, and the Hall assembly 9 may comprise a Hall plate 91 and a magnet 92, one of the Hall plate 91 and the magnet 92 being provided at the fixed bracket 31, and the other of the Hall plate 91 and the magnet 92 being provided on the rotary bracket 32. When the rotary bracket 32 needs to rotate by a specified angle with respect to the fixed bracket 31, through the coordination of the Hall plate 91 and the magnet 92, the working purpose of controlling the rotary bracket 32 to rotate around the pitch axis by a specified angle can be achieved, and the pitch angle of the rotation of the handpiece 20 of the fan can be controlled, and then the air supply apparatus 10 can meet the requirements of different air supply angles of a user.

In some embodiments of the present disclosure, the depression angle of the rotary bracket 32 may be set to A, meeting the relational expression: $-10° \leq A \leq 0°$, and the elevation angle of rotary bracket 32 may be set as B, meeting the relational expression: $0° \leq B \leq 90°$. Such setting can enable handpiece 20 of a fan to have a pitch angle of 100° in the up and down direction, and can enable handpiece 20 to have sufficient air supply area in the up and down direction and the air supply apparatus 10 can meet the air supply requirement of a user.

In some embodiments of the present disclosure, as shown in FIGS. 8 and 10, the air supply apparatus 10 may further include: a damping mechanism 93, and the damping mechanism 93 may be arranged on the fixed bracket 31, and the damping mechanism 93 is pivotably connected to the rotary bracket 32, i.e. the damping mechanism 93 is connected to the rotary bracket 32, and the rotary bracket 32 is pivotable with respect to the damping mechanism 93. The damping mechanism 93 is made of a wear-resistant material, and damping oil is added in a groove of the damping mechanism 93; after the assembly of the air supply apparatus 10 is completed, when the rotary bracket 32 rotates around a pivot axis, the damping mechanism 93 can play a damping effect, and can better keep the stable rotation of the rotary bracket 32; when the rotary bracket 32 is forced to rotate under the driving of an external force, the rotation driving mechanism 3 can be better prevented from being damaged, and at the same time, the damping mechanism 93 can play a supporting role on the rotary bracket 32, and can prevent the rotary bracket 32 from shaking. It needs to be noted that the damping mechanism 93 can use a damper with different specification structures according to actual conditions.

In some embodiments of the present disclosure, as shown in FIG. 8, the rotary bracket 32 may have a damping mechanism connection structure 324. The damping mechanism connection structure 324 is sleeved on the damping mechanism 93 and the overall structure of the second fixed seat 2 and rotation driving mechanism 3 is more compact.

In some embodiments of the present disclosure, as shown in FIG. 8, the damping mechanism connection structure 324 may have a first routing channel 325, and the damping mechanism 93 may have a second routing channel 94 in communication with the first routing channel 325. A wiring harness connecting the driving motor may pass through the first routing channel 325 and the second routing channel 94 and then connect with the driving motor and the wiring of the air supply apparatus 10 may be more convenient. Further, the structural arrangement of the damping mechanism connection structure 324 and the damping mechanism 93 may be reasonable.

A household appliance 100 proposed according to some embodiments of the present disclosure will be described below with reference to FIGS. 15 to 23.

As shown in FIGS. 15 and 20 to 23, according to one embodiment of the present disclosure, the present disclosure proposes a household appliance 100, including: a first fixed seat 1, a second fixed seat 2, and a rotation driving mechanism 3.

Specifically, the rotation driving mechanism 3 comprises a fixed bracket 31 and a rotary bracket 32. The fixed bracket 31 is connected to the second fixed seat 2, and the rotary bracket 32 is connected to the first fixed seat 1; among other things, the rotary bracket 32 is adapted to rotate around the fixed bracket 31 to link the first fixed seat 1 to rotate around the second fixed seat 2.

The household appliance 100 provided by the present disclosure comprises a second fixed seat 2, a first fixed seat 1, and a rotation driving mechanism 3. The second fixed seat 2 and the first fixed seat 1 are connected via the rotation driving mechanism 3, and the rotation driving mechanism 3 can drive the first fixed seat 1 to rotate to realize the automatic adjustment of the pitch angle of the first fixed seat 1. Specifically, the rotation driving mechanism 3 comprises a fixed bracket 31 and a rotary bracket 32. The fixed bracket 31 is connected to the second fixed seat 2, the rotary bracket 32 is connected to the first fixed seat 1, and the rotary bracket 32 is adapted to rotate around the fixed bracket 31. Therefore, the first fixed seat 1 can be driven to rotate around the fixed bracket 31, that is, the first fixed seat 1 can be driven to rotate around the second fixed seat 2, to realize the rotation of the first fixed seat 1 and the components connected thereto in the household appliance 100.

Specifically, a rotation driving mechanism 3 is provided between the second fixed seat 2 and the first fixed seat 1, and the first fixed seat 1 is driven to rotate by the rotation driving mechanism 3, to achieve the automatic adjustment of the pitch angle of the first fixed seat 1 and the components thereon. Specifically, the second fixed seat 2 and the first fixed seat 1 are connected by means of the rotation driving mechanism 3. In the rotary rotation driving mechanism 3, the rotary bracket 32 can rotate around the circumference of the fixed bracket 31, and the structure is simple and reliable, and making the household appliance 100 more reliable.

Specifically, The axis around which the rotary bracket 32 rotates around the fixed bracket 31 is perpendicular to the length direction of the second fixed seat 2. For example, when the first fixed seat 1 is fixed on a plane or aground, the axis around which the rotary bracket 32 rotates is set in the horizontal direction, Therefore, the first fixed seat 1 can be enabled to rotate to the upward side of the household appliance 100, or to the downward side of the household appliance 100, that is, the adjustment of the pitch angle of the first fixed seat 1 is realized.

Specifically, the first fixed seat 1 has at least one supporting point.

Figure 20:
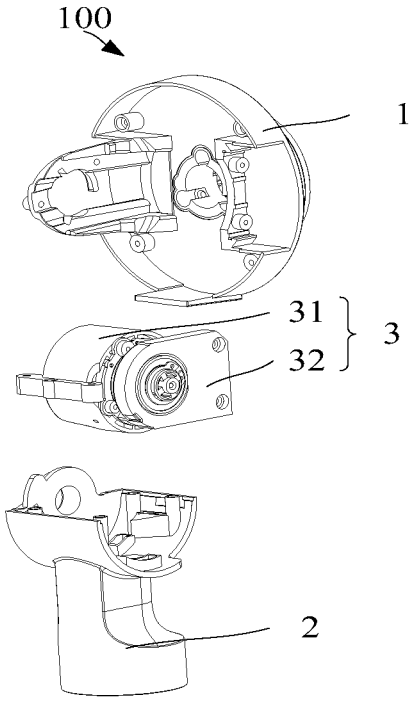
FIG. 20 is a schematic view of a partial exploded structure of a household appliance according to one embodiment of the present disclosure.
Figure 21:
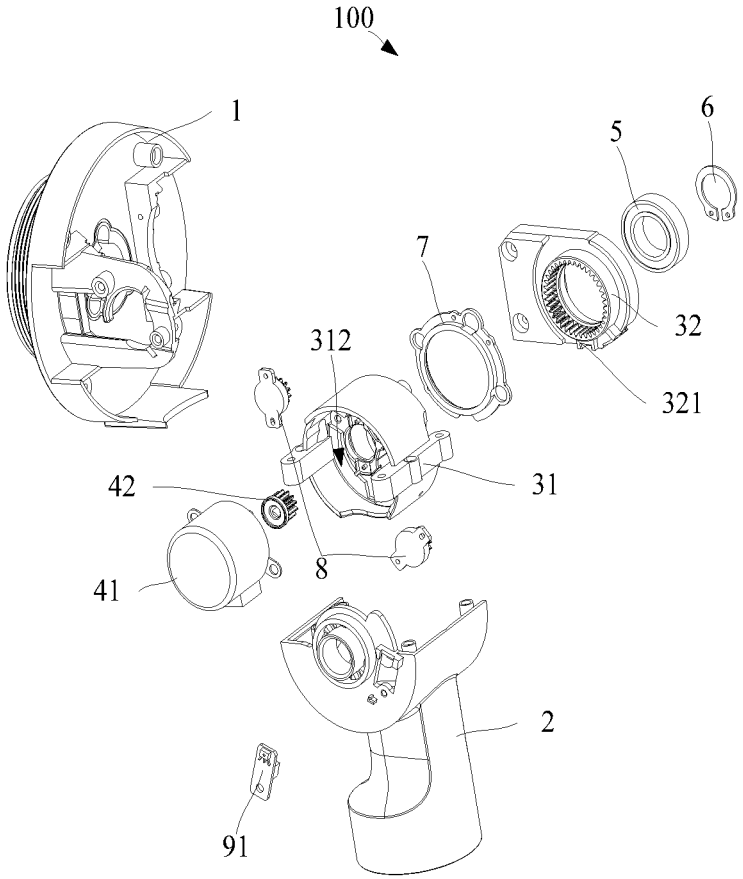
FIG. 21 is another schematic view of a partial exploded structure of a household appliance according to one embodiment of the present disclosure.

Specifically, as shown in FIGS. 20 and 21, the portion of the rotary bracket 32 connected to the first fixed seat 1 supports the first fixed seat 1 and the first fixed seat 1 rotates with the rotation of the rotary bracket 32 by taking the supporting point as the center, that is, the first fixed seat 1 can be connected to the second fixed seat 2 through a single arm. Furthermore, the first fixed seat 1 further comprises a support portion, and the support portion is rotatably connected to the second fixed seat 2, and the support portion coincides with the axis about which the second fixed seat 2 rotates and the axis about which the rotary bracket 32 rotates around the fixed bracket 31; that is to say, the first fixed seat 1 can also be connected to the second fixed seat 2 via a two-arm form.

Figure 16:
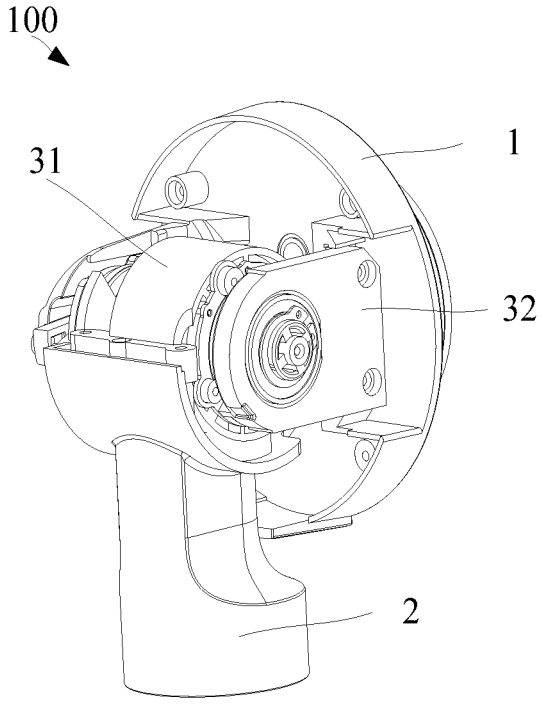
FIG. 16 is a schematic structural view of a household appliance according to one embodiment of the present disclosure.
Figure 17:
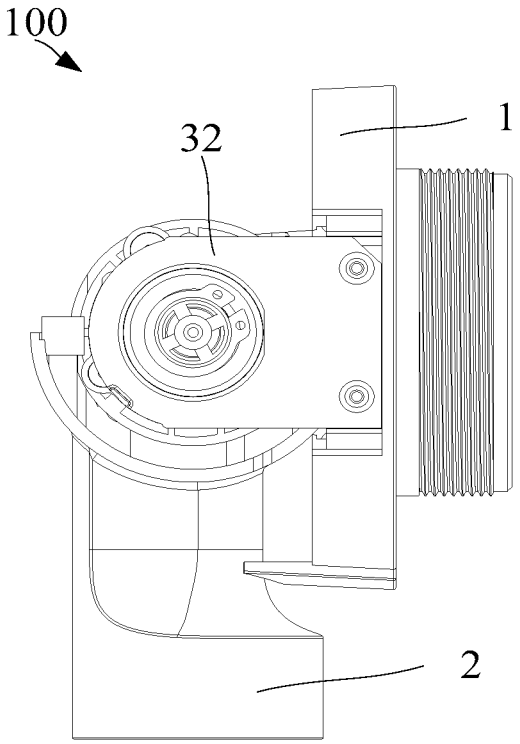
FIG. 17 is a left side view of a household appliance according to one embodiment of the present disclosure.
Figure 18:
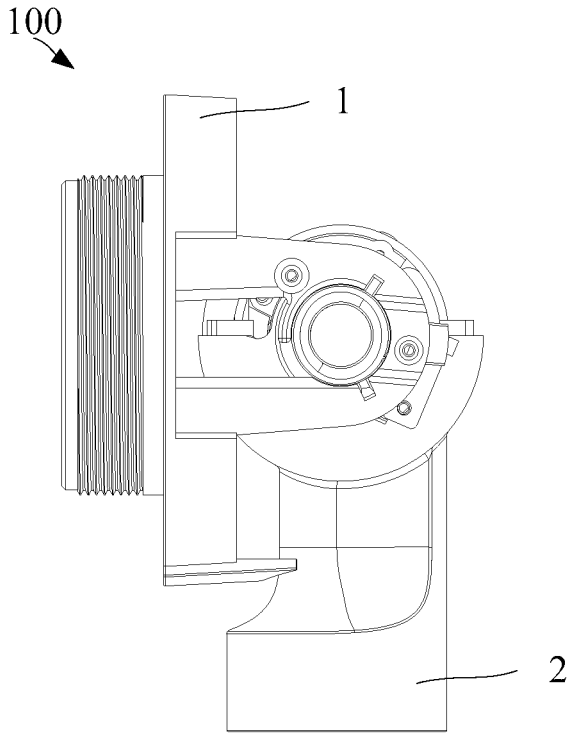
FIG. 18 is a right view of a household appliance according to one embodiment of the present disclosure.
Figure 19:
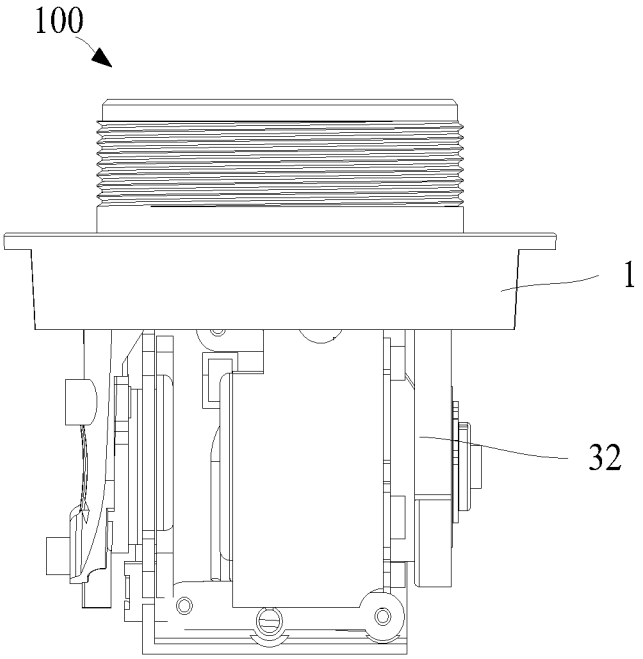
FIG. 19 is a top view of a household appliance according to one embodiment of the present disclosure.

Specifically, as shown in FIG. 16, the second fixed seat 2 and the first fixed seat 1 are connected to the rotary bracket 32 via the fixed bracket 31, and the rotary bracket 32 rotates around the fixed bracket 31 and the first fixed seat 1 rotates around the second fixed seat 2, and achieving the automatic adjustment of the pitch angle of the first fixed seat 1. Shown in FIGS. 17 and 18 are a left side view and a top view of the household appliance 100. FIG. 19 is a top view of the household appliance 100. It can be seen from FIGS. 17 to 19 that the structure is simple and the occupied size is smaller.

Figure 22:
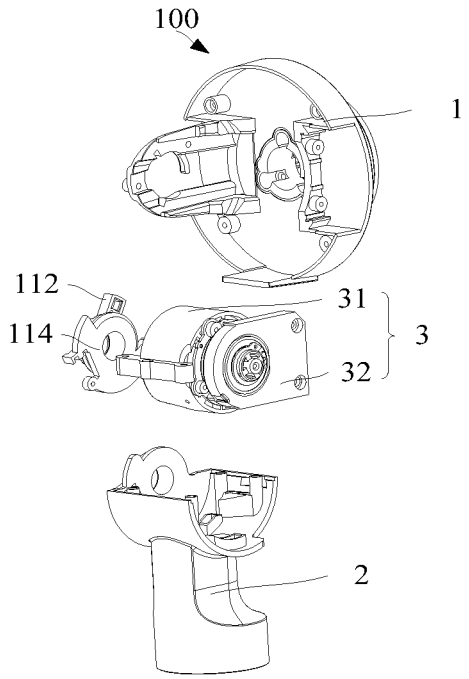
FIG. 22 is a schematic view of a partial exploded structure of a household appliance according to another embodiment of the present disclosure.
Figure 23:
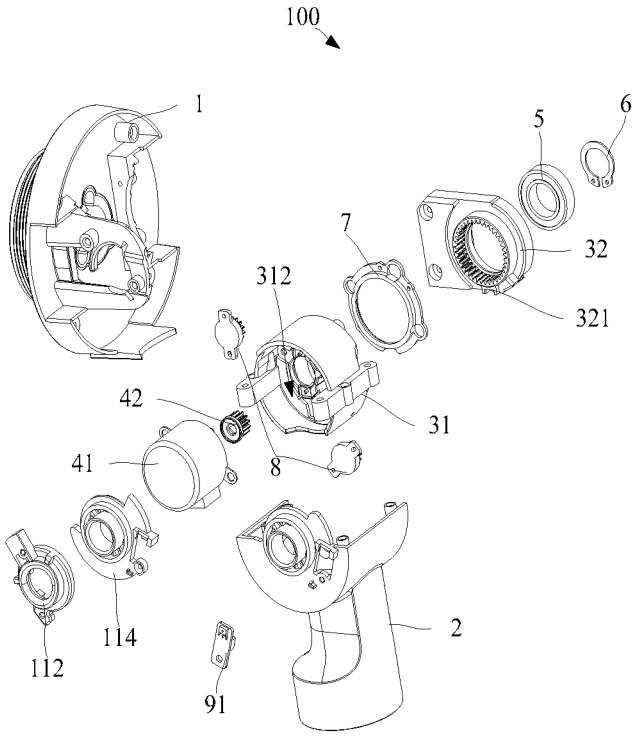
FIG. 23 is another schematic exploded structural view of a household appliance according to the embodiment shown in FIG. 22.

As shown in FIGS. 22 and 23, according to one embodiment of the present disclosure, the features defined by the embodiments described above are included, and further: the household appliance 100 further includes: a first damping frame 112 connected to the first fixed seat 1, and a second damping frame 114 connected to the fixed bracket 31, and the second damping frame 114 is sleeved on the first damping frame 112, and the first damping frame 112 is adapted to rotate around the second damping frame 114.

In this embodiment, the household appliance 100 further comprises a first damping frame 112 and a second damping frame 114. The first damping frame 112 is connected to the first fixed seat 1, and the second damping frame is connected to the fixed bracket 31. Therefore, the first fixed seat 1 can be supported by the first damping frame 112 and the second damping frame 114, and the reliability of the mounting of the first fixed seat 1 is improved. The second damping frame 114 is sleeved on the first damping frame 112, and the first damping frame 112 can rotate around the second damping frame 114 and the first fixed seat 1 can rotate around the second fixed seat 2 under the driving of the rotary bracket 32.

It could be understood that the axis around which the first damping frame 112 rotates around the second damping frame 114 coincides with the axis around which the rotary bracket 32 rotates around the fixed bracket 31.

Specifically, the coordination of the first damping frame 112 and the second damping frame 114 serves as a support for the first fixed seat 1, that is, the first fixed seat 1 can rotate by taking the first damping frame 112 and the second damping frame 114 as supporting points.

Specifically, as shown in FIGS. 22 and 23, the first fixed seat 1 has two supporting points. One supporting point is composed of a portion of the first fixed seat 1 connected to the rotary bracket 32, and the other supporting point is composed of a portion of the first fixed seat 1 connected to the first damping frame 112.

Further, the first damping frame 112 and the second damping frame 114 are located at one end of the fixed bracket 31, and the portion of the rotary bracket 32 connected to the first fixed seat 1 is located at the other end of the fixed bracket 31, namely, in the direction of the axis around which the rotary bracket 32 rotates. The two supporting points of the first fixed seat 1 are located at both ends of the rotation driving mechanism 3, and improving the supporting effect on the first fixed seat 1 and ensuring the reliability of the household appliance 100.

Further, damping fluid is provided between the first damping frame 112 and the second damping frame 114.

In this embodiment, damping fluid is provided between the first damping frame 112 and the second damping frame 114 to provide a damping force as the first damping frame 112 rotates around the second damping frame 114, ensuring the stability of the household appliance 100.

It could be understood that the second damping frame 114 is sleeved on the first damping frame 112, i.e. the inner side wall of the second damping frame 114 is sleeved outside the outer side wall of the first damping frame 112. Damping fluid is provided between the first damping frame 112 and the second damping frame 114, i.e. the damping fluid is provided between the outer side wall of the first damping frame 112 and the inner side wall of the second damping frame 114 and the damping fluid provides a damping force when the first damping frame 112 and the second damping frame 114 perform a rotational movement.

Specifically, a groove is provided on the first damping frame 112 and/or the second damping frame 114, and damping fluid is provided in the groove. It could be understood that damping fluid is a liquid capable of generating a damping force, and capable of damping the kinetic energy of a moving machine by virtue of the viscous drag of the liquid medium. Specifically, the damping fluid includes a viscous liquid, such as oily liquid and the like, depending on the specific usage condition.

According to one embodiment of the present disclosure, a feature defined in any of the above embodiments is included, and further: the rotation angle of the first fixed seat 1 is greater than 0° and less than or equal to 200°.

In this embodiment, the rotation angle of the first fixed seat 1 is greater than or equal to 0° and less than or equal to 200°. Specifically, the elevation angle of the rotation of the first fixed seat 1 is greater than or equal to 0° and less than or equal to 90°, and the depression angle of the first fixed seat 1 is greater than or equal to 0° and less than or equal to 10°, and the elevation angle of the first fixed seat 1 is the angle of the rotation of the first fixed seat 1 from a horizontal position to an upward side, and the depression angle of the first fixed seat 1 is the angle of the rotation of the first fixed seat 1 from a horizontal position to a downward side.

According to one embodiment of the present disclosure, the features as defined in any of the above embodiments are included, and further: in any of the above embodiments, further, the household appliance 100 further comprises: a Hall plate 91 arranged on the second fixed seat 2, and the first fixed seat 1 is further provided with a magnetic member, and the Hall plate 91 is connected to the magnetic member.

In this embodiment, the Hall plate 91 is provided on the second fixed seat 2, and a magnetic member is provided on the first fixed seat 1. The movement of the first fixed seat 1 at any angle can be realized through the coordination between the Hall plate 91 and the magnetic member, namely, the coordination between the Hall plate 91 and the magnetic member can enable the first fixed seat 1 to rotate any specified angle around the second fixed seat 2. For example, the first fixed seat 1 is required to rotate any specified angle around the second fixed seat 2 by 30° or 60° or 90°, etc. from an initial position.

Specifically, the Hall plate 91 is an component with the Hall effect.

According to one embodiment of the present disclosure, the features defined in any of the above embodiments are included, and further: the second fixed seat 2 is provided with a hollow portion, the hollow portion is provided corresponding to the first damping frame 112, the household appliance 100 further comprises a connecting wire, and the connecting wire is adapted to be connected to the second fixed seat 2 by passing through the hollow portion from the first fixed seat 1.

In this embodiment, the second fixed seat 2 is provided with a hollow portion, and the household appliance 100 further comprises a connecting wire. The connecting wire can pass through the hollow portion, namely, the connecting wire can pass through the hollow portion to connect to the first fixed seat 1 and other components thereon and the wiring of the household appliance 100 is more reliable.

According to one embodiment of the present disclosure, the features defined in any of the above embodiments are included, and further: the rotation driving mechanism 3 further includes: a driving member 41, and the driving member 41 and the fixed bracket 31 are connected; and a first transmission member 42, and the first transmission member 42 is connected to the driving member 41 and the rotary bracket 32, respectively, the driving member 41 being adapted to drive the first transmission member 42 to rotate to link the rotary bracket 32 to rotate.

In this embodiment, the driving member 41 drives the first transmission member 42 to rotate and the first transmission member 42 drives the rotary bracket 32 to rotate; it could be understood that the first transmission member 42 rotates to link the rotary bracket 32 to rotate, namely, the driving member 41 drives the first transmission member 42 to rotate; since the first transmission member 42 is connected to the rotary bracket 32, the first transmission member 42 can drive the rotary bracket 32 to move, namely, the first transmission member 42 rotation links the rotary bracket 32 to rotate.

Specifically, the driving member 41 comprises a motor, and the motor may be a synchronous motor or a stepping motor.

According to one embodiment of the present disclosure, the features defined by the embodiments described above are included, and further: the fixed bracket 31 includes: a body portion, and the body portion is connected with the driving member 41 and the second fixed seat 2; and a mounting post connected to the body portion, and the rotary bracket 32 is sleeved on the mounting post, and the rotary bracket 32 is adapted to rotate about the mounting post.

In this embodiment, the fixed bracket 31 comprises a body portion and a mounting post, and the driving member 41 is fixed on the body portion. Meanwhile, the rotation driving mechanism 3 can also be fixed on other apparatuses via the body portion. The mounting post is provided on the body portion, and the rotary bracket 32 is sleeved on the mounting post, to realize the rotation of the rotary bracket 32 around the mounting post, and improve the reliability of the connection between the fixed bracket 31 and the rotary bracket 32.

Specifically, the rotary bracket 32 can rotate circumferentially around the fixed bracket 31. Sleeving the rotary bracket 32 on the mounting post of the fixed bracket 31 can reduce the size of the rotation driving mechanism 3.

Further, the body portion has a mounting groove 312, and the first transmission member 42 is provided on the mounting groove 312; a first through hole is provided on the wall surface of the mounting groove 312, the first through hole penetrates through the wall surface of the mounting groove 312, and the first transmission member 42 is connected to the rotary bracket 32 via the first through hole.

In this embodiment, the body portion has a mounting groove 312 with the first transmission member 42 provided within the mounting groove 312 to avoid the exposure of the first transmission member 42 to the outer side which affects the aesthetics of the rotation driving mechanism 3. The first transmission member 42 is provided in the mounting groove 312, and in order to realize the connection between the first transmission member 42 and the rotary bracket 32, a first through hole is provided in the wall surface of the mounting groove 312. This allows the first transmission member 42 to be connected to the rotary bracket 32 via the first through hole. It could be understood that the first through hole is a through hole penetrating through the wall surface of the mounting groove 312.

Specifically, the rotary bracket 32 is sleeved on the outer side of the mounting groove 312.

According to one embodiment of the present disclosure, the features defined by the embodiments described above are included, and further: the rotary bracket 32 includes: a connection portion, and the connection portion is sleeved on the mounting post, and one end of the connection portion away from the driving member 41 is connected to the first fixed seat 1; and a second transmission member 321 connected to the connection portion, and the first transmission member 42 is connected to the second transmission member 321, and the first transmission member 42 is adapted to drive the second transmission member 321 to rotate to link the connection portion to rotate.

In this embodiment, the rotary bracket 32 comprises a connection portion and a second transmission member 321 which are connected. The connection portion is sleeved on the mounting post, the second transmission member 321 is connected to the first transmission member 42, the driving member 41 drives the first transmission member 42 to rotate, and the first transmission member 42 drives the second transmission member 321 to rotate and the connection portion connected to the second transmission member 321 rotates around the mounting post, i.e. the rotary bracket 32 rotates around the fixed bracket 31.

Specifically, the connection portion and the second transmission member 321 are of an integrated structure.

Specifically, the first transmission member 42 is connected to the second transmission member 321 via the first through hole.

According to one embodiment of the present disclosure, the features defined by the embodiments described above are included, and further: the household appliance 100 further includes: a damper 8 connected to the body portion and provided on the mounting groove 312, the damper 8 including a third rotational member; and the second through hole is provided on the wall surface of the mounting groove 312, the second through hole penetrates through the wall surface of the mounting groove 312, and the third rotational member is connected to the second transmission member 321 via the second through hole.

In this embodiment, the household appliance 100 further includes a damper 8. The damper 8 is mounted on the body portion and housed in the mounting groove 312. The damper 8 comprises a third rotational member, and the third rotational member is connected to the second transmission member 321. When the rotation driving mechanism 3 works, the driving member 41 drives the first transmission member 42 to rotate, the first transmission member 42 drives the second transmission member 321 to rotate, and the second transmission member 321 drives the third rotational member to rotate. When the third rotational member rotates, a damping effect can be generated. That is to say, the kinetic energy of the rotation of the second transmission member 321 is consumed when the third rotational member rotates and the kinetic energy of the rotation of the second transmission member 321 is attenuated, and forming a damping effect. The damper 8 ensures the stability of the rotation driving mechanism 3 during working, and at the same time, when the rotary bracket 32 is forcedly driven by an external force, the reliability of the rotation driving mechanism 3 can be ensured by the damping effect of the damper 8.

Specifically, the damper 8 further comprises a fixed seat and a limiting seat, and the limiting seat is provided on the fixed seat, the third rotational member is sleeved on the limiting seat, and the third rotational member and the limiting seat are adapted to accommodate damping fluid therebetween.

Specifically, the damper 8 comprises a fixed seat and a limiting seat. The fixed seat is used for mounting the damper 8 on the body portion, the limiting seat is mounted on the fixed seat, and the third rotational member is sleeved on the limiting seat to mount the third rotational member on the fixed seat. The third rotational member can rotate around the limiting seat, and damping fluid is accommodated between the third rotational member and the limiting seat. When the third rotational member rotates, it can drive the damping fluid between the third rotational member and the limiting seat to have a certain position change to generate energy consumption to generate resistance to the movement of the third rotational member and form a damping effect.

It could be understood that damping fluid is a liquid capable of generating a damping force, and capable of damping the kinetic energy of a moving machine by virtue of the viscous drag of the liquid medium. Specifically, the damping fluid includes a viscous liquid, such as oily liquid and the like, depending on the specific usage condition.

Of course, the damper 8 may be another mechanism capable of forming a damping effect.

Further, each of the first transmission member 42, the second transmission member 321, and the third rotational member comprises a gear structure, and the first transmission member 42 and the second transmission member 321 are drivingly engaged through a gear structure, and the second transmission member 321 and the third rotational member are drivingly engaged through a gear structure.

In this embodiment, the first transmission member 42, the second transmission member 321, and the third rotational member all comprise a gear structure, and the first transmission member 42 and the second transmission member 321 are connected via the gear structure to realize a gear transmission and improve the reliability of the connection therebetween. The second transmission member 321 and the third rotational member are connected via the gear structure to realize a gear transmission and improve the reliability of the connection therebetween.

Specifically, the first transmission member 42 is an outer gear, the second transmission member 321 is an inner gear, and the third rotational member is an outer gear. That is to say, the first transmission member 42 and the second transmission member 321 are both located in the second transmission member 321 and are connected to the third rotational member. The rotation of the first transmission member 42 can drive the rotation of the second transmission member 321, and the rotation of the third rotational member can have a damping effect on the rotation of the second transmission member 321.

According to one embodiment of the present disclosure, the features defined by the embodiments described above are included, and further: the driving member 41 comprises a rotor and an output shaft connected to the rotor, and the output shaft is connected to the first transmission member 42. The rotation axis of the rotor, the axis of the mounting post, and the axis around which the rotary bracket 32 rotates are arranged coaxially, or the rotation axis of the rotor and the axis of the mounting post do not coincide.

In this embodiment, the driving member 41 comprises an output shaft and a rotor, and the rotor rotates to drive the output shaft to rotate and the first connecting member is driven to rotate via the output shaft. The axis rotated by the rotor, the axis of the mounting post, and the axis around which the rotary bracket 32 rotates are arranged coaxially and the space occupied by the rotation driving mechanism 3 is reduced. Alternatively, the axis around which the rotor rotates and the axis of the mounting post do not coincide, i.e. the rotary bracket 32 moves eccentrically with respect to the driving member 41, and the rotation driving mechanism 3 can be applied to different apparatuses depending on the actual situation.

According to one embodiment of the present disclosure, the features defined in any one of the above embodiments are included, and further: the household appliance 100 further includes: a support bearing 5 provided between the rotary bracket 32 and the mounting post; a limiting member along the direction of the axis about which the rotary bracket 32 rotates, the limiting member being located at one end of the rotary bracket 32 away from the driving member 41; a friction plate 7, along the direction of the axis about which the rotary bracket 32 rotates, the friction plate 7 being arranged between the rotary bracket 32 and the limiting member; and a limiting structure connected to the fixed bracket 31, the limiting structure being adapted to limit the rotation angle of the rotary bracket 32.

In this embodiment, the household appliance 100 further comprises a support bearing 5. The support bearing 5 is mounted inside the rotary bracket 32 and nested on the mounting post for connecting the rotary bracket 32 and the mounting post; the household appliance 100 further comprises a limiting member, and the limiting member is arranged on the rotary bracket 32 and is located at one end of the rotary bracket 32 away from the driving member 41; at the same time, the limiting member is clamped on the fixed bracket 31, and defining the support bearing 5 on the mounting post; the household appliance 100 further comprises a friction plate 7 mounted between the rotary bracket 32 and the limiting member and being made of a wear-resistant and easy-to-wear material, which can achieve the control of the gap between the rotary bracket 32 and the fixed bracket 31 and stabilize the rotation driving mechanism 3; at the same time, the friction plate 7 has a lubricating effect when the rotary bracket 32 rotates. The fixed bracket 31 is further provided with a limiting structure thereon, and the limiting structure can limit the rotary bracket 32 to fix the rotated rotary bracket 32 after rotation in a specified position.

Specifically, the limiting member is a snap spring. Specifically, the friction plate 7 is a gasket made of a wear-resistant material, and further, the friction plate 7 is an elastic cushion.

Further, the household appliance 100 includes any one of the fan, air conditioner, and heater.

In this embodiment, the household appliance 100 comprises any one of the fan, air conditioner, or heater. Specifically, when the household appliance 100 is a fan, the mounting portion is a support structure, the rotational portion is a fan head, and the axis around which the rotary bracket 32 rotates in the rotation driving mechanism 3 is perpendicular to the length direction of the support structure and the fan head can rotate up and down, namely, the adjustment of the pitch angle of the fan head is realized.

Specifically, when a household air conditioner comprises a heater, the heater comprises a head portion and a support portion. The head portion is provided with a heat-dissipating structure, the head portion and the support portion are connected via the rotation driving mechanism 3, and the rotation axis of the rotary bracket 32 can be arranged perpendicular to the length direction of the support portion, and achieving the adjustment of the pitch angle of the heater.

As shown in FIGS. 15 to 23, according to one specific embodiment of the present disclosure, a household appliance 100 comprises a second fixed seat 2, a first fixed seat 1, and a rotation driving mechanism 3, the first fixed seat 1 being used for fixing an appliance such as a fan head of a fan. The first fixed seat 1 is used for supporting and mounting the rotation driving mechanism 3, and the second fixed seat 2, the first fixed seat 1 and the rotation driving mechanism 3 are supported via a fulcrum; the single-arm uses one fulcrum (the supporting point formed by the portion of the rotary bracket 32 connected with the first fixed seat 1), the two-arm uses two fulcrums (the supporting point formed by the portion of the rotary bracket 32 connected with the first fixed seat 1, and the supporting point formed by the first fixed seat 1, the first damping frame 112, and the second damping frame 114), and by centering on the fulcrum, first fixed seat 1 rotates with the operation of driving member 41 (motor) in rotation driving mechanism 3.

The maximum depression angle is designed to be −10°, and the maximum elevation angle is designed to be 90°. According to the need, the pitch angle (the other side) can be adjusted from −10° to 90°, and the pitch angle ranges from 0° to 200°. Further, if the Hall plate is added, any angle adjustment from −10° to 90° and 90° to −10° can be realized.

As shown in FIG. 20, a single-arm household appliance 100 capable of realizing an automatic pitch function is shown, including a second fixed seat 2, a first fixed seat 1, and a rotation driving mechanism 3, and the exploded view is as shown in FIG. 21, specifically comprising:

- the second fixed seat 2 used to fix the appliance and, at the same time, fix the fixed bracket 31 in rotation driving mechanism 3;
- the first fixed seat 1 used to fix and support the rotation driving mechanism 3, and rotate by taking a fulcrum as the center under the driving of the rotation driving mechanism 3;
- a fixed bracket 31: support and fix rotation driving mechanism 3, in which the driving motor, the driving gear, and the damper are mounted in it;
- a driving motor: used to provide the driving force for rotation and transmit power to the rotary bracket 32 through the driving gear;
- a driving gear: fixed on the driving motor, and coordinating with the internal gear of the rotary bracket 32 to realize power transmission;
- a damper 8: fixed in the fixed bracket 31 and coordinating with the internal gear of the rotary bracket 32 to ensure the stability during the movement or the reliability of the rotation driving mechanism 3 when forced to be driven by an external force;
- a rotary bracket 32: fixed on the first fixed seat 1, and under the action of the driving motor, the first fixed seat 1 is linked to achieve rotation;
- a friction plate 7: mounted between the rotary bracket 32 and the fixed bracket 31 and made of a wear-resistant and easy-to-wear material, and it firstly achieves the control of the gap between the rotary bracket 32 and the fixed bracket 31 to stabilize the rotation driving mechanism 3, and secondly, the friction plate 7 provides a lubricating effect when the rotary bracket 32 rotates;
- a support bearing 5: nested on the mounting post of fixed bracket 31 and outer sleeved in rotary bracket 32, to ensure the relative rotation between the two;
- a snap spring: fixing the support bearing 5 on the mounting post of the fixed bracket 31; and
- a Hall plate 91: implementing any angle control on a program.

The working principle of the household appliance 100 proposed in the present disclosure is that: when the driving motor moves, power is transmitted to the rotary bracket 32 by driving the gear, and the rotary bracket 32, together with the first fixed seat 1, rotates by taking the fulcrum as the center.

Figure 9:
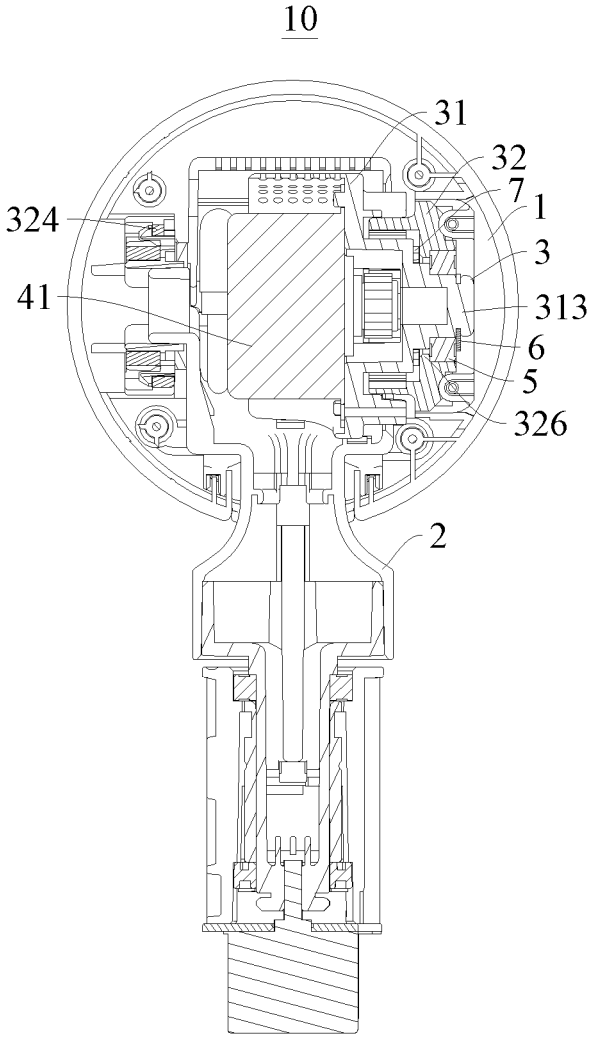
FIG. 9 is a cross-sectional view of an air supply apparatus's first fixed seat and second fixed seat, and a rotation driving mechanism of a first embodiment according to an embodiment of the present disclosure.

As shown in FIG. 22, a two-arm household appliance 100 capable of realizing an automatic pitch function is shown, including a second fixed seat 2, a first fixed seat 1, and a rotation driving mechanism 3, and the exploded view is as shown in FIG. 9, specifically comprising:

- the second fixed seat 2 used to fix the appliance and, at the same time, fix the fixed bracket 31 in rotation driving mechanism 3;
- the first fixed seat 1 used to fix and support the rotation driving mechanism 3, and rotate by taking a fulcrum as the center under the driving of the rotation driving mechanism 3;
- a fixed bracket 31: support and fix rotation driving mechanism 3, in which the driving motor, the driving gear, and the damper are mounted in it;
- a driving motor: used to provide the driving force for rotation and transmit power to the rotary bracket 32 through the driving gear;
- a driving gear: fixed on the driving motor, and coordinating with the internal gear of the rotary bracket 32 to realize power transmission;
- a damper 8: fixed in the fixed bracket 31 and coordinating with the internal gear of the rotary bracket 32 to ensure the stability during the movement or the reliability of the rotation driving mechanism 3 when forced to be driven by an external force;
- a rotary bracket 32: fixed on the first fixed seat 1, and under the action of the driving motor, the first fixed seat 1 is linked to achieve rotation;
- a friction plate 7: mounted between the rotary bracket 32 and the fixed bracket 31 and made of a wear-resistant and easy-to-wear material, and it firstly achieves the control of the gap between the rotary bracket 32 and the fixed bracket 31 to stabilize the rotation driving mechanism 3, and secondly, the friction plate 7 provides a lubricating effect when the rotary bracket 32 rotates;
- a support bearing 5: nested on the mounting post of fixed bracket 31 and outer sleeved in rotary bracket 32, to ensure the relative rotation between the two;
- a snap spring: fixing the support bearing 5 on the mounting post of the fixed bracket 31;
- a Hall plate 91: implementing any angle control on a program;
- a first damping frame 112: made of wear-resistant material and fixed on the first fixed seat 1, and coordinating with second damping frame 114 to achieve the supporting and damping effects; and
- a second damping frame 114: made of wear-resistant material and fixed on the fixed bracket 31, and damping oil is added in the groove to coordinate with the first damping frame 112 to achieve the supporting and damping effects.

The working principle of the household appliance 100 proposed in the present disclosure is that: when the driving motor moves, power is transmitted to the rotary bracket 32 by driving the gear, and the rotary bracket 32, together with the first fixed seat 1, rotates by taking the fulcrum as the center.

The wiring at the joint is on the side of the first damping frame 112, and the middle of the left side of the movable joint of the first fixed seat 1 is hollowed out, which is convenient and reliable for wiring. This design uses the joint movement mode to add a friction plate 7 and a damper 8. The adjustment of the pitch angle of the appliance is skillfully realized through modular assemblies such as the rotation driving mechanism 3 and the mechanism is stable and reliable, and the mounting is simple. By adjusting the power of the driving motor, the structure is optimized according to the product, which can be used for most apparatuses with automatic adjusting movement.

In the present disclosure, the term "multiple" refers to two or more unless explicitly defined otherwise. Terms "mounted", "connected", "connect", "fixed", and the like are to be construed broadly. For example, "connect" may be a fixed connection, a detachable connection, or an integral connection; "connected" can be either directly connected or indirectly connected through an intermediary. The specific meaning of the above-mentioned terms in the present disclosure can be understood according to specific situations.

In the specification of the present disclosure, the description of "one embodiment", "some embodiments", "specific embodiments", etc. mean that a specific feature, structure, material, or characteristic described in connection with the embodiment or example is included in at least one embodiment or example of the present disclosure. In the specification, schematic representations of the above terms do not necessarily refer to the same embodiment or example. Furthermore, the specific feature, structure, material, or characteristic described may be combined in any suitable manner in any one or more embodiments or examples.

What is claimed is:

1. An air supply apparatus, comprising: a first fixed seat; a second fixed seat, the second fixed seat being connected to a handpiece of the air supply apparatus; and a rotation driving mechanism, the rotation driving mechanism having a fixed bracket and a rotary bracket, the fixed bracket being fixedly connected to the first fixed seat, and the rotary bracket being fixedly connected to the second fixed seat, wherein the rotary bracket is sleeved on the fixed bracket, and the rotation driving mechanism further has a driving assembly, and the driving assembly is adapted to drive the rotary bracket to rotate around a pitch axis, wherein the driving assembly comprises: a driving member and a first transmission member, wherein the first transmission member is connected to the driving member, and the rotary bracket is provided with a second transmission member drivingly engaging with the first transmission member; wherein the rotation driving mechanism further comprises: a support bearing, wherein the fixed bracket comprises a body portion, the body portion defines a mounting groove, an outer wall surface of a bottom wall of the mounting groove is provided with a mounting post, an inner ring of the support bearing is sleeved on the mounting post, and an outer ring of the support bearing is connected to the rotary bracket.

2. The air supply apparatus according to claim 1, wherein the pitch axis is parallel to a horizontal plane.

3. The air supply apparatus according to claim 1, wherein the rotary bracket defines a through-hole, the through-hole passing through the rotary bracket in a thickness direction of the rotary bracket, and the through-hole being sleeved on an outer side of the fixed bracket and the support bearing.

4. The air supply apparatus according to claim 3, wherein an inner wall surface of the through-hole is provided with an annular boss and the inner wall surface of the annular boss is provided with the second transmission member.

5. The air supply apparatus according to claim 4, wherein the inner wall surface of the through-hole is provided with a stopper boss, the stopper boss being located between the annular boss and the support bearing, and the stopper boss abutting the support bearing.

6. The air supply apparatus according to claim 1, wherein the rotation driving mechanism further comprises: a snap spring, wherein the snap spring is sleeved on the mounting post and located at one end of the support bearing away from the fixed bracket.

7. The air supply apparatus according to claim 1, wherein the rotation driving mechanism further comprises: a bearing inner ring stop, wherein the bearing inner ring stop is provided on the fixed bracket and is located at one end of the support bearing away from the fixed bracket.

8. The air supply apparatus according to claim 1, wherein the rotation driving mechanism further comprises: a bearing outer ring stop, the bearing outer ring stop being provided on the rotary bracket and located at one end of the support bearing away from the fixed bracket.

9. The air supply apparatus according to claim 1, wherein the rotation driving mechanism further comprises: an annular friction plate, the body portion being sleeved on an outer side of the friction plate, and the friction plate being sleeved on the outer side of the rotary bracket.

10. The air supply apparatus according to claim 1, wherein a side wall of the mounting groove has a first through hole, the first transmission member being located in the mounting groove, and the first transmission member drivingly mating with the second transmission member through the first through hole.

11. The air supply apparatus according to claim 1, wherein the first transmission member is a gear and the second transmission member is a rack.

12. The air supply apparatus according to claim 1, wherein the rotation driving mechanism further comprises: a damper, a side wall of the mounting groove having a second through hole, the damper being provided in the mounting groove, and the damper drivingly mating with the second transmission member by passing through the second through hole.

13. The air supply apparatus according to claim 1, wherein the rotation driving mechanism further comprises:

a Hall assembly, wherein the Hall assembly comprises a Hall plate and a magnet, and one of the Hall plate and the magnet is provided on the fixed bracket, and the other is provided on the rotary bracket.

14. The air supply apparatus according to claim 1, wherein a depression angle of the rotary bracket is A, meeting a relational expression: $-10° \leq A \leq 0°$;

an elevation angle of the rotary bracket is B, meeting a relational expression: $0° \leq B \leq 90°$.

15. The air supply apparatus according to claim 1, further comprising:

a damping mechanism, the damping mechanism being provided on the fixed bracket and being pivotably connected to the rotary bracket.

16. The air supply apparatus according to claim 15, wherein the rotary bracket has a damping mechanism connection structure, the damping mechanism connection structure being sleeved on the damping mechanism.

17. The air supply apparatus according to claim 16, wherein the damping mechanism connection structure has a first routing channel and the damping mechanism has a second routing channel communicating with the first routing channel.

* * * * *